US009141049B2

(12) United States Patent
Tanaka

(10) Patent No.: US 9,141,049 B2
(45) Date of Patent: Sep. 22, 2015

(54) IMAGE FORMING APPARATUS AND TEMPERATURE CONTROL METHOD IN FIXING DEVICE THEREOF FOR CONTROLLING TEMPERATURE OF FIXING DEVICE TO BE AT TARGET TEMPERATURE AFTER EXECUTION OF NON-IMAGE FORMATION DEVICE

(75) Inventor: Yu Tanaka, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 803 days.

(21) Appl. No.: 13/324,591

(22) Filed: Dec. 13, 2011

(65) Prior Publication Data

US 2012/0155907 A1 Jun. 21, 2012

(30) Foreign Application Priority Data

Dec. 15, 2010 (JP) ..... 2010-279690

(51) Int. Cl.
*G03G 15/20* (2006.01)

(52) U.S. Cl.
CPC ..... *G03G 15/205* (2013.01)

(58) Field of Classification Search
CPC ..... G03G 15/205
USPC ..... 399/69, 70, 67, 320, 324, 328, 330
See application file for complete search history.

(56) References Cited

U.S. PATENT DOCUMENTS 6,308,022 B1 * 10/2001 Sasai ..... 399/70
8,699,906 B2 * 4/2014 Miyamoto et al. ..... 399/70

(Continued)

FOREIGN PATENT DOCUMENTS

JP 6-115216 4/1994
JP 7-287474 10/1995

(Continued)

OTHER PUBLICATIONS

Machine English Translation of JP06-115216 published on Apr. 26, 1994.*

(Continued)

*Primary Examiner* — Billy Lactaoen
(74) *Attorney, Agent, or Firm* — Holtz, Holtz, Goodman & Chick PC

(57) ABSTRACT

Image forming apparatus including: first executing unit executing image formation mode of forming image by transferring toner image from image holder onto recording sheet, and then, in fixing device, causing fixing member, heated to fixable temperature by heater, to thermally fix toner image; second executing unit executing non-image-formation mode not involving thermal fixing performed by fixing device; instructing unit selectively instructing to execute image formation mode or non-image-formation mode; and controller controlling power supply to heater of fixing device in accordance with execution state of image formation and non-image-formation modes, the controller performing first control of decreasing temperature of fixing member by stopping or reducing power supply to heater when non-image-formation mode starts, and second control of stopping first control at predetermined timing during execution of non-image-formation mode and increasing temperature of fixing member so as to reach predetermined target temperature at end of execution of non-image-formation mode.

25 Claims, 22 Drawing Sheets

(56) References Cited

U.S. PATENT DOCUMENTS

| | | | |
|---|---|---|---|
| 2001/0004425 | A1 | 6/2001 | Shinohara et al. |
| 2004/0057756 | A1 | 3/2004 | Taka et al. |
| 2007/0098426 | A1 | 5/2007 | Soya |
| 2008/0279578 | A1 | 11/2008 | Monde |

FOREIGN PATENT DOCUMENTS

| | | |
|---|---|---|
| JP | 2001-166553 | 6/2001 |
| JP | 2002-356038 | 12/2002 |
| JP | 2004-117738 | 4/2004 |
| JP | 2005-62587 | 3/2005 |
| JP | 2006-308984 | 11/2006 |
| JP | 2007-65597 | 3/2007 |
| JP | 2007-79038 | 3/2007 |
| JP | 2007-322708 | 12/2007 |
| JP | 2008-281607 | 11/2008 |
| JP | 2010-134130 | 6/2010 |
| JP | 2010-145907 | 7/2010 |

OTHER PUBLICATIONS

Notification of Reasons for Refusal mailed Feb. 26, 2013, directed to Japanese Application No. 2010-279690; 9 pages.

* cited by examiner

FIG. 6A

Non-print mode process time table

| Non-print mode | Process time |
|---|---|
| Monochrome density adjustment process | 10 seconds |
| Color density adjustment process | 30 seconds |
| Color shift correction process | 60 seconds |
| Full stabilization process | 90 seconds |
| Internal device temp reduction process | Uncertain |
| ... | ... |
| ... | ... |

FIG. 6B

| Whether print mode process is executed after non-print mode process ends | Target temp Ta |
|---|---|
| Yes | 200° C |
| No | 170° C |

Vd: temp fall velocity during heater OFF
Vu: temp rise velocity during heater ON
α: non-print mode process time α : color shift correction process time
β : full stabilization process time
Vu: temp rise velocity
T : fixing unit temp
t : time FIG. 16A $\alpha > \gamma$
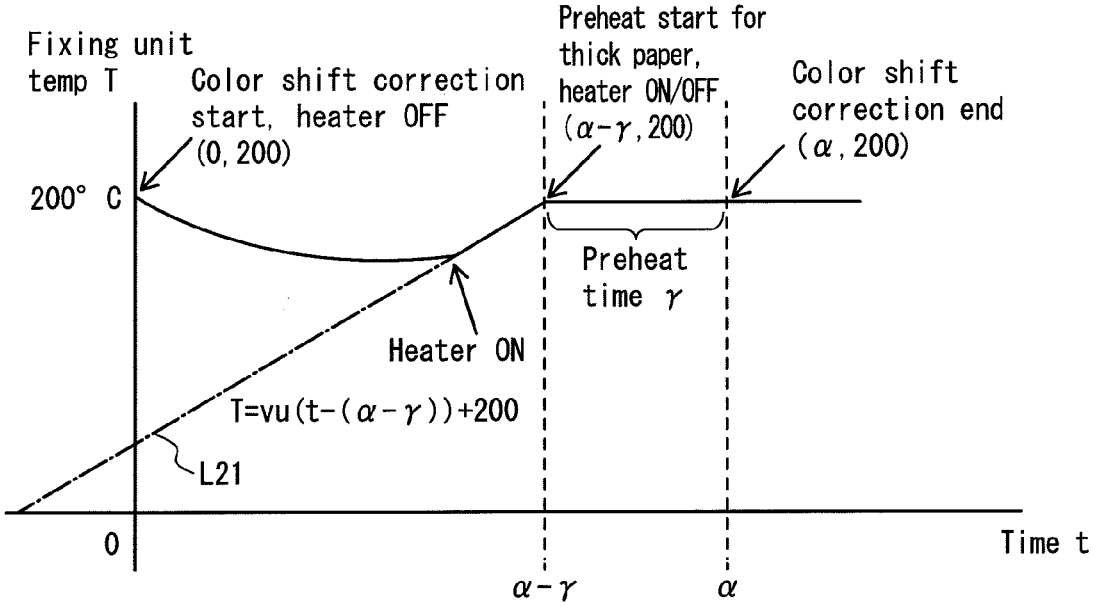
$\alpha$: color shift correction process time
$\gamma$: preheat process time
Vu: temp rise velocity
T : fixing unit temp
t : time
FIG. 16B $\alpha \leq \gamma$
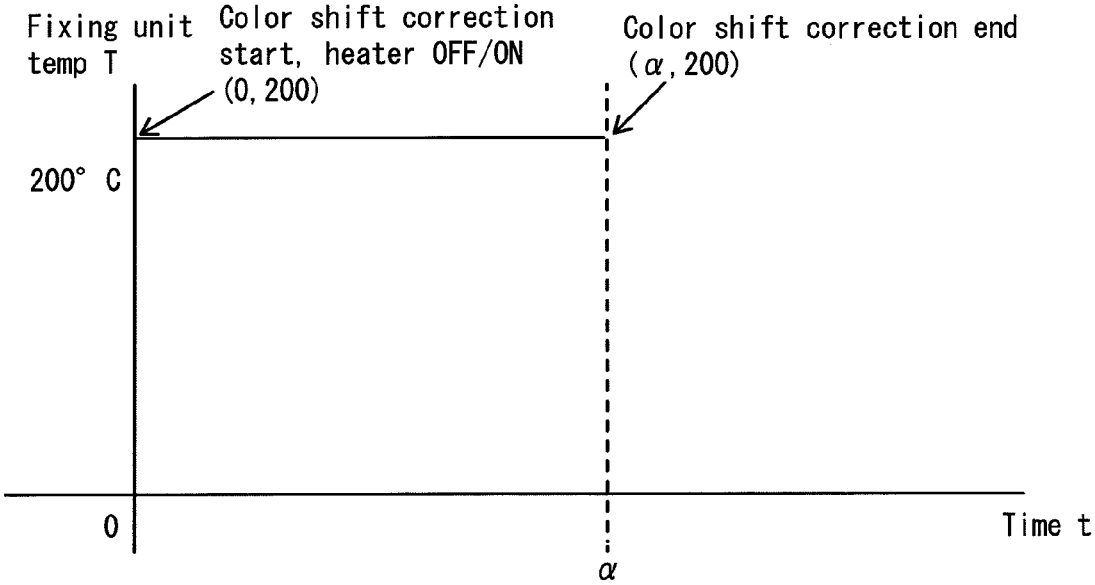
$\alpha$: color shift correction process time
$\gamma$: preheat process time
T : fixing unit temp
t : time FIG. 19A $\alpha \leqq \delta$
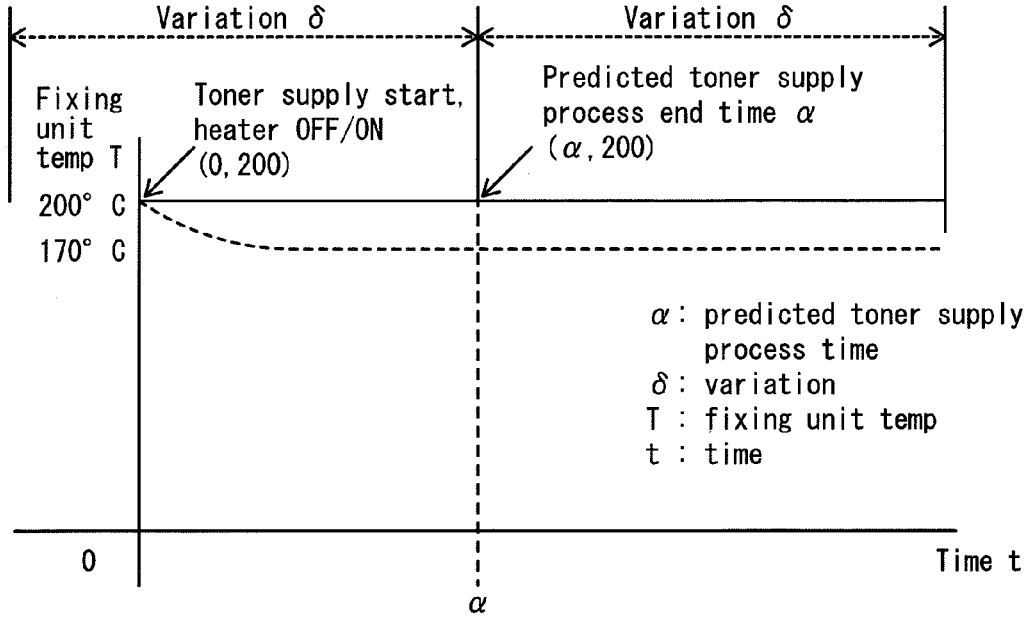
FIG. 19B $\alpha > \delta$
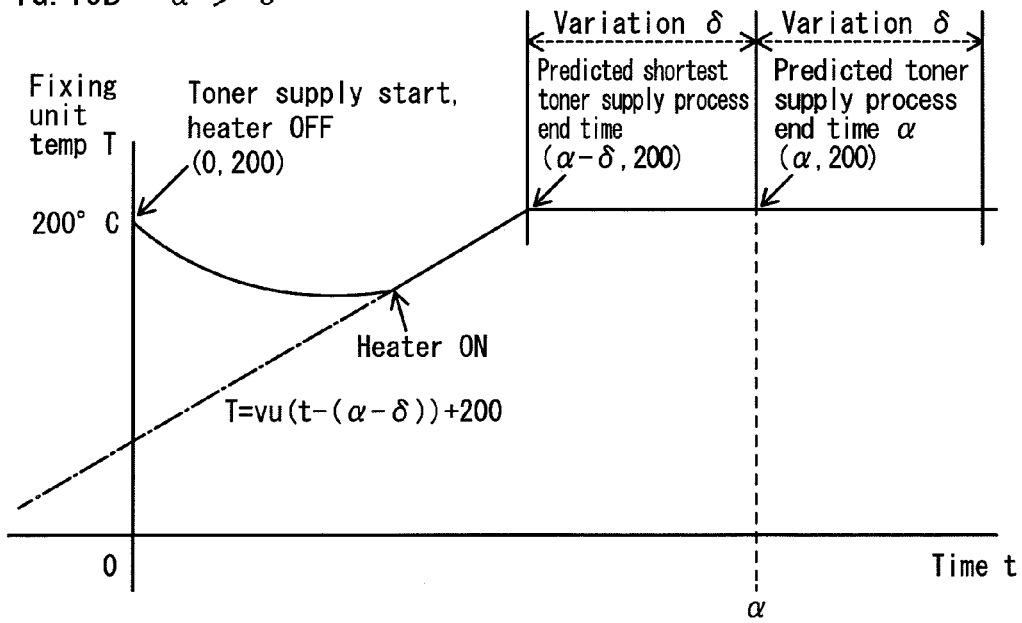
α : predicted toner supply process time
δ : variation
T : fixing unit temp
t : time

IMAGE FORMING APPARATUS AND TEMPERATURE CONTROL METHOD IN FIXING DEVICE THEREOF FOR CONTROLLING TEMPERATURE OF FIXING DEVICE TO BE AT TARGET TEMPERATURE AFTER EXECUTION OF NON-IMAGE FORMATION DEVICE

This application is based on an application No. 2010-279690 filed in Japan, the contents of which are hereby incorporated by reference.

BACKGROUND OF THE INVENTION (1) Field of the Invention

The present invention relates to an image forming apparatus, and in particular to a technology for performing a temperature control in a fixing device of the image forming apparatus.

(2) Description of the Related Art

In an image forming apparatus of the photoelectric method, after a charger electrically charges the surface of a photosensitive drum in a unified manner, it forms an electrostatic latent image on the photosensitive drum by emitting a laser beam to expose-scan the surface of the charged photosensitive drum, and develops the electrostatic latent image by causing a developing unit to supply toner thereto. The toner image formed on the surface of the photosensitive drum is transferred, via an intermediate transfer belt or directly, onto a recording sheet. Then the recording sheet with the toner image is heated and pressured by a fixing device and the toner image is fixed thermally onto the surface of the recording sheet.

Meanwhile, the temperature of a heating rotating member required for the thermal fixing (fixable temperature) is generally high, for example, 200° C. Especially when the heating rotating member is in the shape of a roller, the thermal capacity is large, and thus requires a lot of time for the warm-up. For this reason, in many apparatuses, the heating rotating member is always kept to be at a temperature close to the fixable temperature, so that a print process can be started as soon as a print job is received (hereinafter, the state is referred to as a "wait state", and the temperature maintained in the wait state is referred to as a "wait temperature". Typically, the wait temperature is set to a temperature that is lower than the fixable temperature by approximately 20° C. to 40° C. so that the fixable temperature can be reached in approximately 10 seconds). Note that in the present specification, "fixable temperature" means a target value of the control for adjusting the surface temperature of the heating rotating member to be within a range of temperature that is required for the toner to be fixed on the recording sheet. Thus in the actual control, slight ripples are generated around the target temperature.

FIG. 24A is a graph showing the change in the temperature (hereinafter referred to as a "fixing unit temperature") T of the heating rotating member during a conventional temperature control of the fixing device, wherein the horizontal axis represents an elapse time t from the activation of the apparatus, and the vertical axis represents the fixing unit temperature T.

After the apparatus is powered on (t=0), the power is supplied continuously to the heater of the fixing device (indicated by "Heater ON" in the graph), and the warm-up is started. When the fixing unit temperature T reaches the wait temperature 170° C., the temperature control is switched to a control in which the power supply to the heater is switched ON/OFF intermittently to maintain the wait temperature. Upon receiving a print job and an instruction to start printing, the apparatus continuously supplies the power to the heater ("Heater ON") to increase the fixing unit temperature T straight to 200° C. in approximately 10 seconds, then starts the printing, and after the printing is over, stops the power supply to the heater to decrease the fixing unit temperature T. When the fixing unit temperature T reaches the wait temperature 170° C., the apparatus performs the control to switch ON/OFF the heater intermittently to maintain the wait temperature.

Meanwhile, most of the power consumed by the image forming apparatus is the power required for heating the heating rotating member in the fixing device. Accordingly, for the sake of energy conservation, many power saving technologies have been proposed conventionally.

For example, Japanese Patent Application Publication No. 2007-65597 discloses a structure of an image forming apparatus that has an operation mode including a recording mode and a non-recording mode, wherein the recording mode causes the fixing device to execute a recording operation for fixing an image onto a recording sheet, and the non-recording mode is performed to execute a non-recording operation other than the recording operation. While the operation mode is set to the recording mode, the temperature of the heater in the fixing device is adjusted to be the fixable temperature, and while the operation mode is set to the non-recording mode (during the time period $\alpha$), the temperature adjustment of the heater is stopped and the power is not supplied ("Heater OFF"), as shown in FIG. 24B.

With the above structure, while the operation mode is set to the recording mode, the recording operation can be started immediately, and while the operation mode is set to the non-recording mode, the power supply to the heater of the fixing device is stopped, thereby preventing wasteful consumption of the power.

However, according to the above conventional technology, the control is made to stop the power supply to the heater for all the period while the non-recording mode is executed, and after the mode is switched to the recording mode, the heater is powered ON. Accordingly, the user has to wait for a time period "tv" required for the warm-up until the printing process is started. This is inconvenience for the user.

SUMMARY OF THE INVENTION

It is therefore an object of the present invention to provide an image forming apparatus that saves as much power as possible without impairing the convenience of the user, and a temperature control method for a fixing device included in the image forming apparatus.

To achieve the above object, as one aspect of the present invention, there is provided an image forming apparatus comprising: a first executing unit that executes an image formation mode of forming an image by transferring a toner image from an image holder onto a recording sheet, and then, in a fixing device, causing a fixing member heated to a fixable temperature by a heater to thermally fix the toner image on the recording sheet; a second executing unit that executes a non-image-formation mode that does not involve a thermal fixing performed by the fixing device; an instructing unit that selectively instructs the first executing unit to execute the image formation mode or the second executing unit to execute the non-image-formation mode; and a controller that controls a power supply to the heater of the fixing device in accordance with an execution state of the image formation mode and the non-image-formation mode, the controller performing a first control of decreasing a temperature of the fixing member by stopping or reducing the power supply to the heater when the non-image-formation mode starts to be executed, and a second control of stopping the first control at a predetermined timing in a middle of the execution of the non-image-formation mode and then increasing the temperature of the fixing member so that the temperature reaches a predetermined target temperature at an end of the execution of the non-image-formation mode.

To achieve the above object, as another aspect of the present invention, there is provided a temperature control method for a fixing device of an image forming apparatus that selectively executes an image formation mode and a non-image-formation mode, the image formation mode being a mode of forming an image by transferring a toner image from an image holder onto a recording sheet, and then, in a fixing device, causing a fixing member heated to a fixable temperature by a heater to thermally fix the toner image on the recording sheet, and the non-image-formation mode being a mode not involving a thermal fixing performed by the fixing device, the temperature control method comprising: a temperature decrease step of decreasing a temperature of the fixing member by stopping or reducing the power supply to the heater when the non-image-formation mode starts to be executed; and a temperature increase step of increasing, at a predetermined timing in a middle of the execution of the non-image-formation mode, the temperature of the fixing member so that the temperature reaches a predetermined target temperature at an end of the execution of the non-image-formation mode.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 6A illustrates an example of the non-print mode process time table; FIG. 6B illustrates a table used for determining a set value of the target temperature Ta;

FIGS. 16A and 16B are graphs showing changes in the fixing unit temperature T in the case where a thick paper print mode process is stopped to execute the color shift correction process; FIG. 16A illustrates the case where the process time $\alpha$ of the color shift correction process is larger than the preheat time $\gamma$; FIG. 16B illustrates the case where the process time $\alpha$ of the color shift correction process is equal to or smaller than the preheat time $\gamma$;

FIGS. 19A and 19B are graphs showing changes in the fixing unit temperature T in the case where a print process is stopped to execute the toner supply process; FIG. 19A illustrates the case where the predicted toner supply process time $\alpha$ is equal to or smaller than the variation amount $\delta$; FIG. 19B illustrates the case where the predicted toner supply process time $\alpha$ is greater than the variation amount $\delta$;

DESCRIPTION OF THE PREFERRED EMBODIMENTS

The following describes an embodiment of an image forming apparatus of the present invention, taking, as an example, a case where the present invention is applied to a tandem color digital printer (hereinafter, merely referred to as a printer).

(1) Overall Structure of Printer 1

Figure 1:
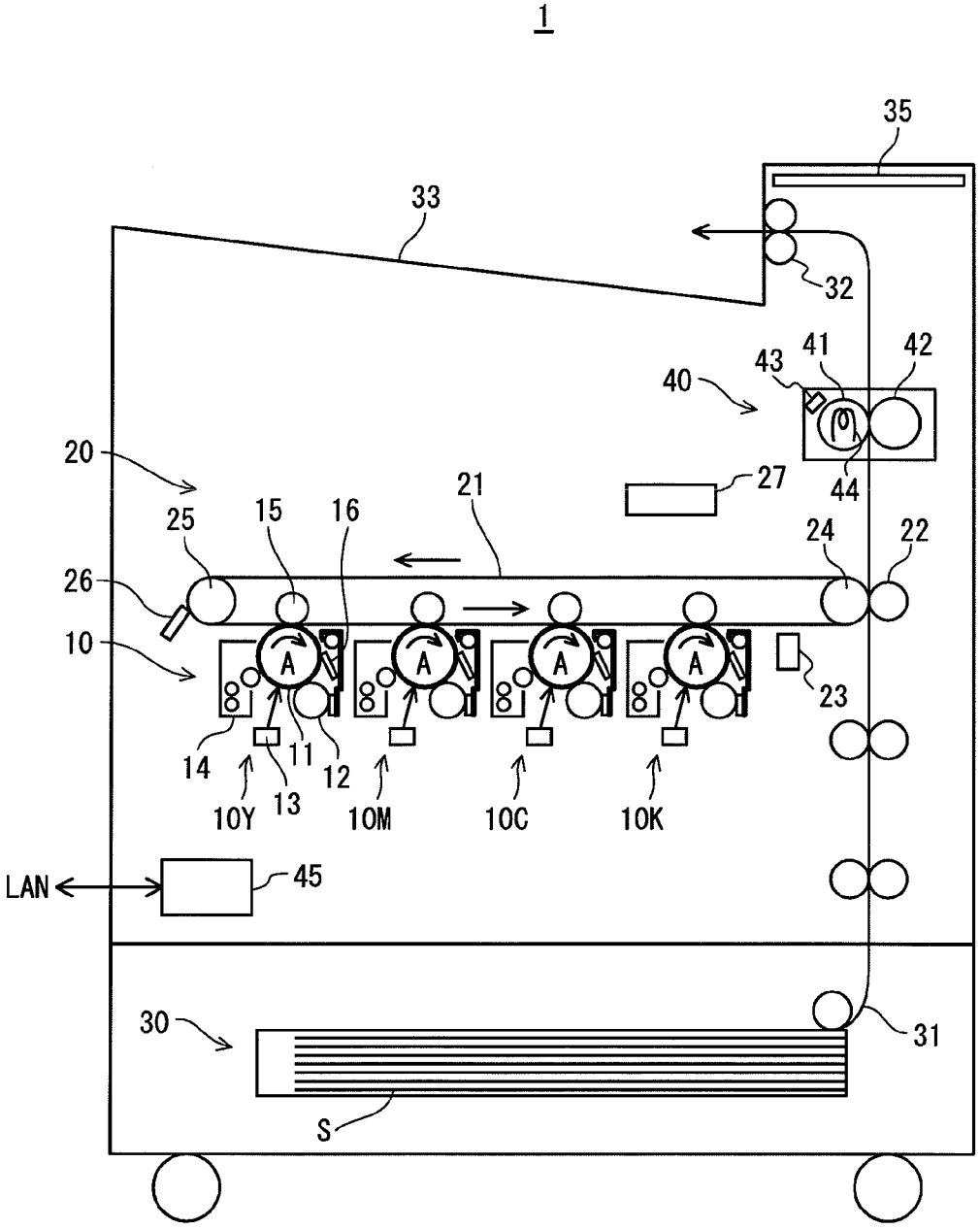
FIG. 1 is a schematic view illustrating an overall structure of a printer in an embodiment of the present invention.

FIG. 1 is a schematic view illustrating an overall structure of a printer 1 in the present embodiment.

The printer 1 forms an image on a recording sheet by the known electrophotographic method, and includes an image process unit 10, an intermediate transfer unit 20, a paper feeder 30, a fixing unit 40, and a controller 45. The printer 1 selectively executes a color or monochrome printing based on a print job received from an external terminal device (not illustrated) via a network (for example, a LAN).

The image process unit 10 includes image creating units 10Y, 10M, 10C, and 10K corresponding to development colors of yellow (Y), magenta (M), cyan (C), and black (K), respectively.

The image creating unit 10Y includes a photosensitive drum 11 and around the photosensitive drum 11: a charger 12; an exposure unit 13; a developing unit 14; a first transfer roller 15; and a cleaner 16.

The charger 12 electrically charges the circumferential surface of the photosensitive drum 11 that rotates in a direction indicated by the arrows A.

The exposure unit 13 exposure-scans the charged photosensitive drum 11 by the laser beam to form an electrostatic latent image on the photosensitive drum 11.

The developing unit 14 contains developer that includes toner, and develops the electrostatic latent image on the photosensitive drum 11 by the toner, thereby creating a toner image of color Y on the photosensitive drum 11.

Note that the developing unit 14 includes a known toner level sensor (not illustrated) for detecting the amount of remaining toner, and is structured to be supplied with toner from a toner bottle (not illustrated) when the amount of remaining toner becomes small.

The first transfer roller 15 transfers the toner image of color Y from the surface of the photosensitive drum 11 onto an intermediate transfer belt 21 by the electrostatic action. The cleaner 16 cleans toner that remains on the surface of the photosensitive drum 11 after the transfer. The other image creating units 10M to 10K have the same structure as the image creating unit 10Y, and their reference signs are omitted in FIG. 1.

Also, the intermediate transfer unit 20 includes the intermediate transfer belt 21 that is suspended with a tension between a drive roller 24 and a passive roller 25 and is driven to move cyclically in the direction indicated by the arrows.

When the color printing (color mode) is performed, toner images of colors corresponding to the image creating units 10Y to 10K are created on the photosensitive drums 11, and the created toner images are transferred onto the intermediate transfer belt 21. The creations of images of colors Y to K are performed at shifted timings so that the images are layered at the same position on the intermediate transfer belt 21, the timings being shifted from the upstream side toward the downstream side in the running direction of the intermediate transfer belt 21.

The paper feeder 30 feeds recording sheets S one by one from a paper feed cassette at the timings corresponding to the image creation timings, and the recording sheets S are transported toward a second transfer roller 22 via a transfer path 31.

When a recording sheet S transported toward the second transfer roller 22 passes through between the second transfer roller 22 and the intermediate transfer belt 21, the toner images of respective colors having been formed on the intermediate transfer belt 21 are transferred onto the recording sheet S in block by the electrostatic action of the second transfer roller 22. This transfer is referred to as a second transfer.

The recording sheet S after the second transfer, in which the toner images of respective colors were transferred thereon, is transported to the fixing unit 40, where it is heated and pressed so that the toner on the recording sheet S is melted and fixed onto the surface of the recording sheet S. The recording sheet S is then ejected onto a tray 33 by a pair of ejection rollers 32.

In the above description, an operation in execution of the color mode is explained. When a monochrome printing (the monochrome mode), for example, a black printing is executed, only the image creating unit 10K for black printing is driven, a recording sheet S is subjected to similar steps of charging, exposure, developing, transfer, and fixing for black printing, and a black image is formed on the recording sheet S.

Note that toner or toner pattern that has remained on the intermediate transfer belt 21 without having been transferred onto the recording sheet S is cleaned by a cleaning blade 26 positioned to face the passive roller 25 with the intermediate transfer belt 21 therebetween.

Also, for example, a reflection type photoelectric sensor 23 is provided more on the downstream side than the image creating unit 10K in the running direction of the intermediate transfer belt 21 to detect, during the image stabilization process, a toner pattern formed on the intermediate transfer belt 21.

The photoelectric sensor 23 is reflection type and includes a light-emitting element and a light-receiving element. The light-emitting element emits light toward the intermediate transfer belt 21. The light-receiving element receives specular reflection light or diffusion light, which is the light emitted by the light-emitting element and reflected on the intermediate transfer belt 21, and outputs a voltage which varies depending on the amount of received specular reflection light or diffusion light. Normally, an LED (Light-Emitting Diode) is used as the light-emitting element, and a PD (PhotoDiode) is used as the light-receiving element.

An environmental sensor 27 detects the temperature and humidity in the printer 1 and outputs a detection signal. By referring to the detection signal, it is determined whether or not the image stabilization process is necessary.

On a front-upper portion of the printer 1, an operation panel 35 is provided at a position where users can easily operate it. The operation panel 35 is provided with buttons, a touch-panel-type liquid crystal display and the like for receiving various instructions from the users. The operation panel 35 conveys the received instructions to the controller 45, or displays, on the liquid crystal display, information or the like that indicates the state of the printer 1.

The controller 45 controls the units of the printer 1, based on the print job data received from the external terminal device via a network, to smoothly carry out the image formation operation. The controller 45 also controls the image stabilization process, the toner supply process based on a toner level sensor 141 of the developing unit 14 for each color, the temperature of a fixing roller 41 in the fixing unit 40, and the like.

(2) Structure of Controller 45

Figure 2:
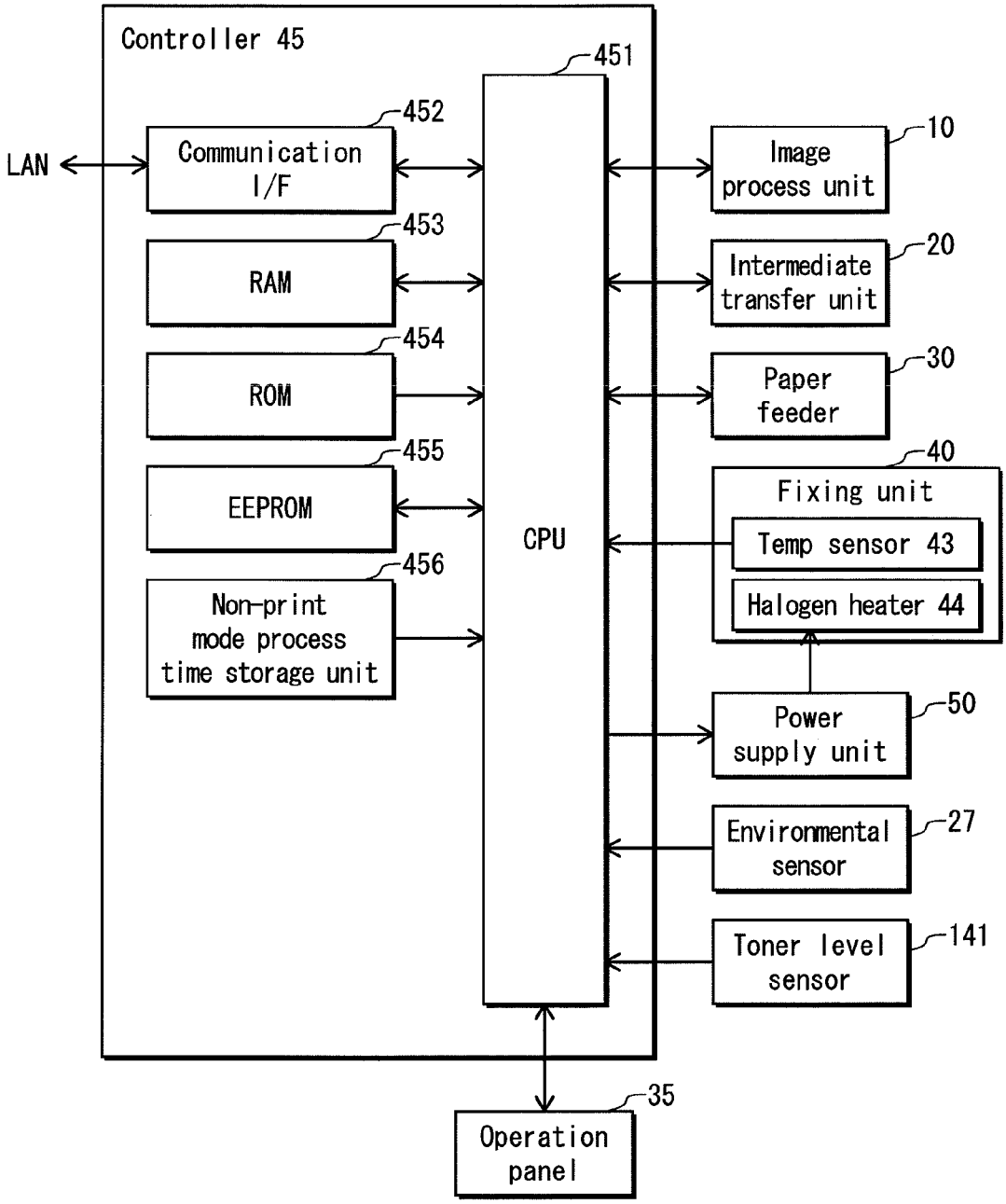
FIG. 2 is a block diagram illustrating the structure of a controller in the printer.

FIG. 2 is a block diagram illustrating the structure of the controller 45.

As shown in FIG. 2, the controller 45 includes a CPU 451, a communication I/F (interface) 452, a RAM 453, a ROM 454, an EEPROM 455, and a non-print mode process time storage unit 456.

The communication I/F 452 is a LAN card or a LAN board for connecting the external client terminal with the LAN, and receives print job data from the client terminal via the LAN and sends the print job data to the CPU 451.

The RAM 453 is a volatile memory and is used as a work area when the CPU 451 executes the program.

The ROM 454 stores a program for controlling the operation of the units of the printer 1, image data for printing the toner patch and resist pattern that are used in the image stabilization process, and the like.

The EEPROM 455 is a recordable nonvolatile memory and stores an accumulated value of the number of prints, and the like.

The non-print mode process time storage unit 456 is a nonvolatile memory and stores values of times that are required to process respective types of non-print modes, the times being obtained preliminarily. Note that a partial memory area of the ROM 454 or the EEPROM 455 may double as the non-print mode process time storage unit 456.

The CPU 451 reads a necessary program from the ROM 454, and controls the units of the printer 1 to selectively execute the print mode or the non-print mode.

In the print mode, operations of the image process unit 10, intermediate transfer unit 20, paper feeder 30, and fixing unit 40 are controlled in a unified manner based on the obtained image data so that the image formation operation (print process) is smoothly executed on the recording sheet. The non-print mode is a process that does not involve the fixing operation performed by the fixing unit 40. The print mode and the non-print mode are selectively executed.

The print mode includes the above-described color mode and monochrome mode, as well as a thick paper print mode in which printing is made onto thick paper.

The non-print mode processes include, for example, a toner density correction process and the image stabilization process that includes a color shift correction process necessary for executing the color mode.

The toner density correction process is, in the present embodiment, executed when the temperature or humidity in the printer detected by the environmental sensor 27 has changed by a predetermined value or greater from the previous toner density correction process. In the toner density correction process, a toner patch for density correction is formed on the intermediate transfer belt 21, light is irradiated from a light source to the toner patch and its reflection light or scattering light is detected by the photoelectric sensor 23. If a value of toner density obtained from the detection result is different from a proper value of density, a control is performed to modify the charging potential on the surface of the photosensitive drum by the charger, output of laser light, developing bias of the developing unit, gradation transform curve (γ curve) and the like so that the reproduced image has a proper image density (hereinafter this process is referred to as "density adjustment process").

The color shift correction process is executed when the temperature in the printer has changed by a predetermined value or greater from the previous color shift correction process or when a predetermined number or more of sheets have been printed in succession. In the color shift correction process, a plurality of toner patterns (resist patterns) for color shift detection for each color are formed on the intermediate transfer belt 21, an amount of positional shift for each color is detected from the timing at which the photoelectric sensor 23 detects the resist patterns, and based on the detected amount of shift, the timing at which the image data is read during the drawing onto each photosensitive drum, and/or the like, are adjusted to correct the shift in the toner image transfer position for each color.

The details and execution timings of these image stabilization processes are known, and further explanation thereof is omitted.

Also, the CPU 451 controls the power supplied to a halogen heater 44 from a power supply unit 50, based on a detection signal from a temperature sensor 43 that detects the surface temperature of a fixing roller 41 in the fixing unit 40 and depending on the execution state of the print and non-print modes so that the fixing roller 41 has a predetermined temperature.

(3) Control of Temperature of Fixing Unit 40 in Non-Print Mode

Figure 24A:
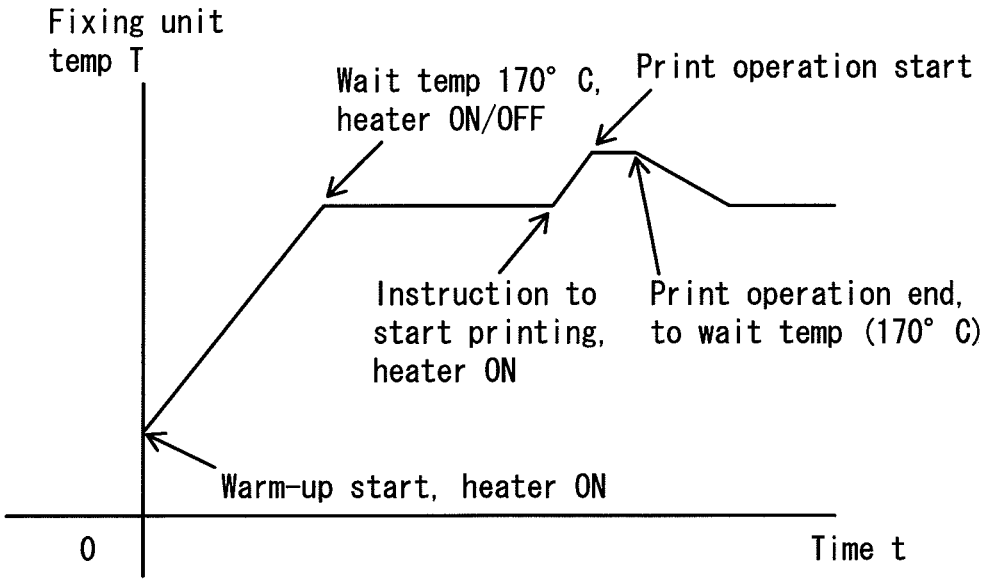
FIG. 24A is a graph showing the change in the fixing unit temperature during a regular temperature control.
Figure 24B:
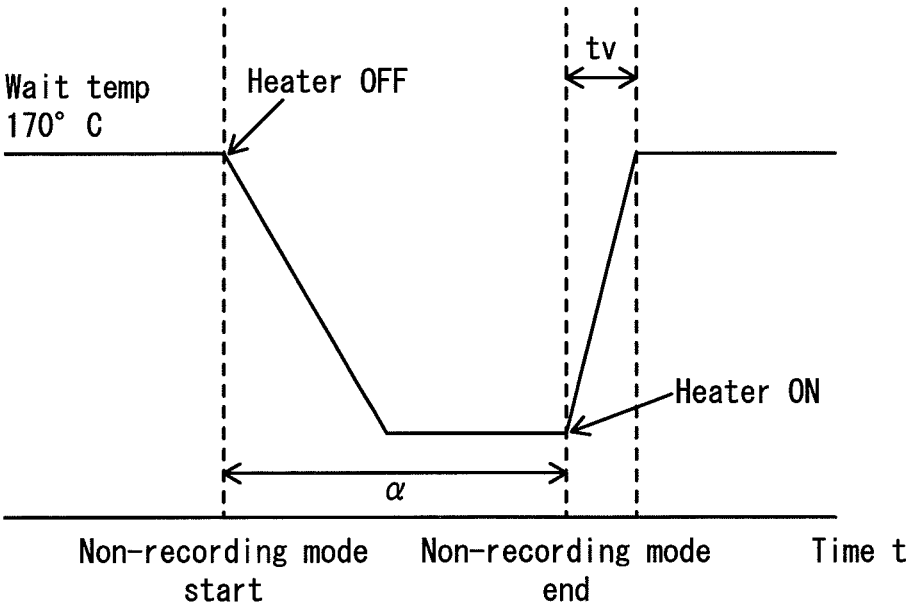
FIG. 24B is a graph showing the change in the fixing unit temperature during an execution of a conventional non-print mode process.

In the present embodiment, normally, the controller 45 controls the temperature of the fixing roller 41 in the fixing unit 40 in a similar manner to the control illustrated in FIG. 24A. However, in the non-print mode, the controller 45 performs the following temperature control to realize both the power saving and user's convenience.

Figure 3:
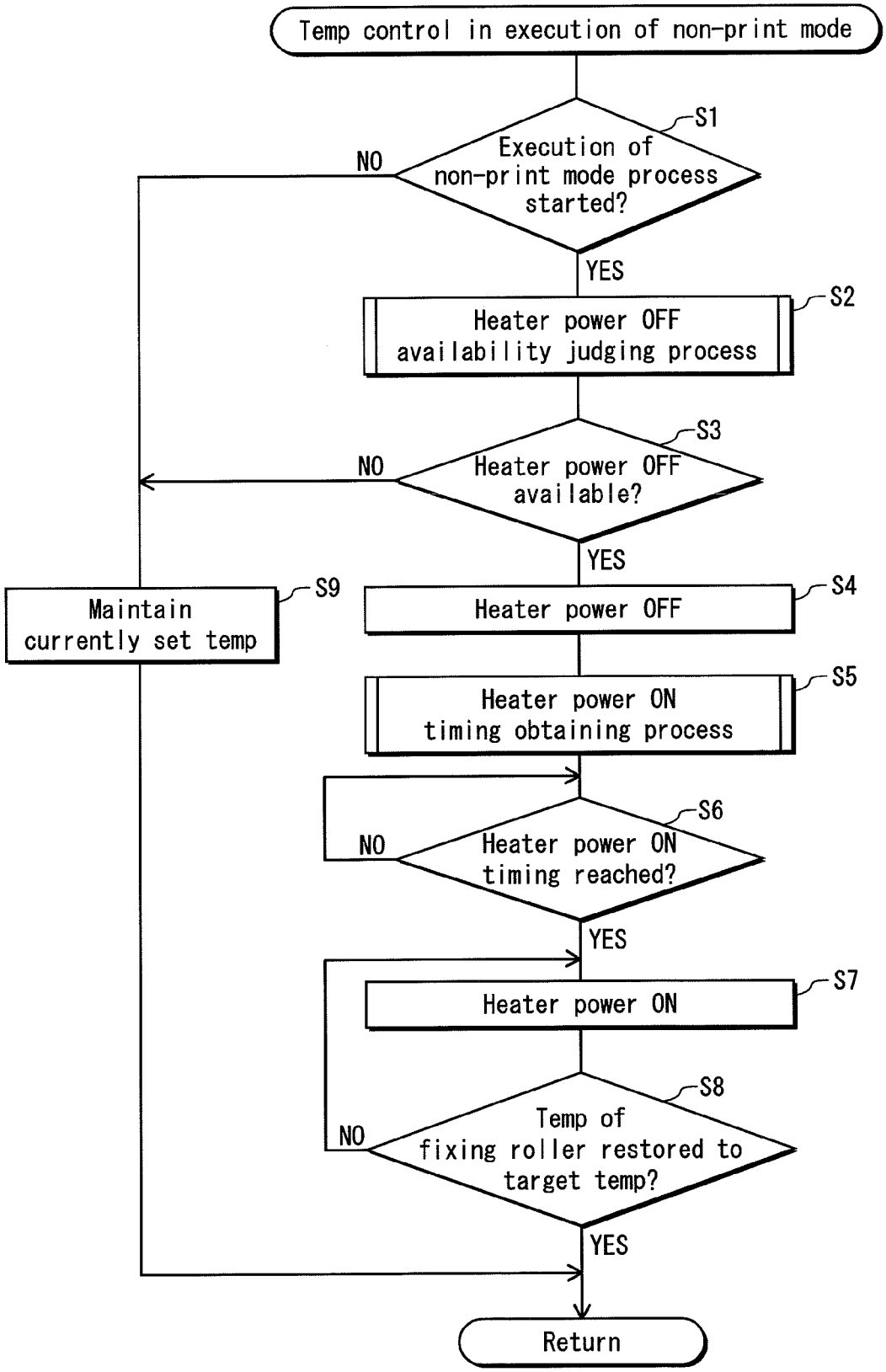
FIG. 3 is a flowchart of a temperature control that is performed in a fixing device during execution of a non-print mode process.

FIG. 3 is a flowchart of the temperature control performed by the controller 45 in the above case, the temperature control being performed as a subroutine of a main flowchart (not illustrated) indicating the control of the whole printer 1.

Note that, hereinafter, a control performed to maintain a predetermined target temperature is referred to as "temperature adjustment control", a continuous stop of power supply to the halogen heater 44 is referred to as "heater power OFF", and a continuous power supply to the halogen heater 44 is referred to as "heater power ON".

First, it is judged whether or not an execution of a non-print mode process has been started (step S1).

In the present embodiment, the non-print mode processes include a monochrome density adjustment process, a color density adjustment process, a color shift correction process, a full stabilization process, and an internal device temperature reduction process (see the table in FIG. 6A).

The monochrome density adjustment process is a density adjustment process performed only on the image creating unit 10K for black when the printer is set to the monochrome mode. The color density adjustment process is a density adjustment process performed on all of the image creating units 10Y to 10K when the printer is set to the color mode.

Also, the full stabilization process is a process in which the color density adjustment process and the color shift correction process are executed in succession.

The internal device temperature reduction process is a process that is performed if the temperature in the device reaches or exceeds a predetermined temperature due to a continuous execution of the print process, and in which the print process is forcibly stopped to reduce the temperature in the device to prevent the toner from converting by the heat.

The timings at which these non-print mode processes are executed are determined separately in the main flowchart.

If it is judged that an execution of a non-print mode process has been started (YES in step S1), a process for judging whether or not the power supply to the halogen heater 44 of the fixing unit 40 should be stopped ("heater power OFF availability judging process") is executed (step S2).

Figure 4:
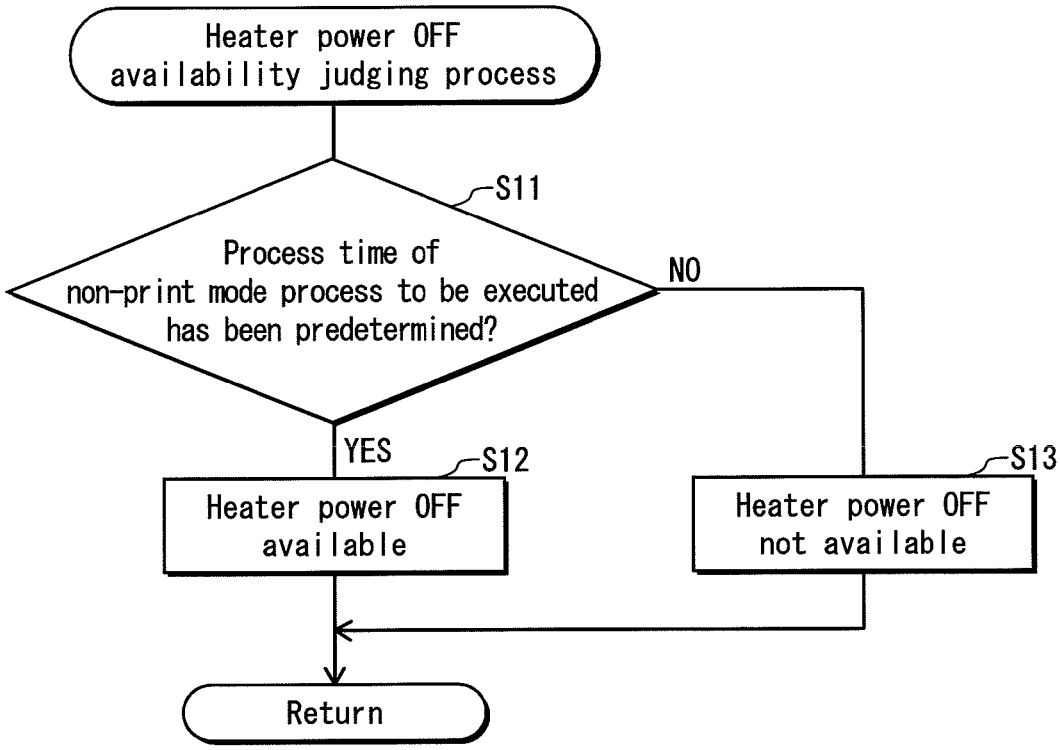
FIG. 4 is a flowchart illustrating a subroutine for the heater power OFF availability judging process performed in step S2 of the flowchart shown in FIG. 3.

FIG. 4 is a flowchart illustrating a subroutine for the heater power OFF availability judging process.

First, it is judged whether or not the process time of the non-print mode process to be executed has been predetermined (step S11).

This judgment is made by referring to a non-print mode process time table stored in the non-print mode process time storage unit 456 (FIG. 2). FIG. 6A illustrates an example of the non-print mode process time table. In this example, the non-print mode process time table indicates various types of processes of the non-print mode that can be executed, and for each process, the time required to execute the process, wherein the respective process times are preliminarily measured and stored.

In this example, the process time of the internal device temperature reduction process is "uncertain". This is because the time is greatly affected by uncertainties such as the temperature outside the device.

In the table of this example, the process times of the processes other than the internal device temperature reduction process are predetermined (step S11: YES). In this case, it is determined as "heater power OFF available" (step S12) since, as described below, it is possible to stop power supply to the halogen heater 44 at the start of the non-print mode process, and then restart heating at a predetermined timing in the middle of the process so that the temperature of the fixing unit is restored to the wait temperature or the fixable temperature at the end of the process.

Conversely, if it is judged that the process time of the non-print mode process to be executed has not been predetermined (NO in step S11), it is determined as "heater power OFF not available" (step S13) since it is uncertain how much time is required before the process ends, and priority is given to the user's convenience.

With step S12 or S13, the subroutine for the heater power OFF availability judging process ends, and the control returns to the flowchart of FIG. 3.

In step S3 of FIG. 3, it is judged whether or not the result of the heater power OFF availability judging process in step S2 is "heater power OFF available" (step S3).

If it is judged in step S3 that the result of step S2 is "heater power OFF not available" (NO in step S3), the temperature adjustment control is performed to maintain the currently set temperature (step S9).

If it is judged in step S3 that the result of step S2 is "heater power OFF available" (YES in step S3), the power supply to the halogen heater 44 is stopped (step S4).

Subsequently, a process ("heater power ON timing obtaining process") for obtaining a timing, at which the heater power ON is to be started so that the temperature of the fixing unit (temperature T) is restored to the target temperature (the wait temperature or the fixable temperature) at the processing end of the non-print mode process, is executed (step S5).

Figure 5:
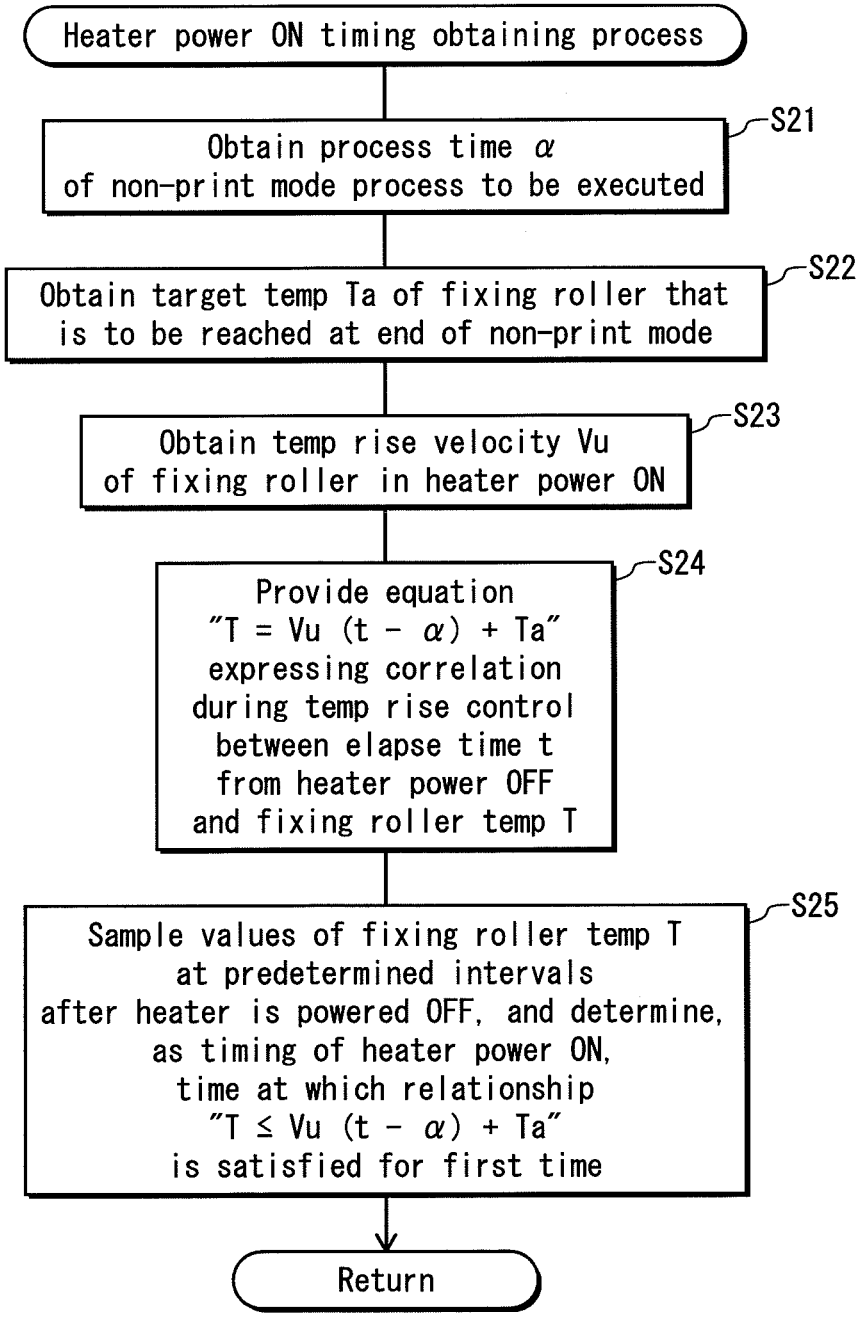
FIG. 5 is a flowchart illustrating a subroutine for the heater power ON timing obtaining process performed in step S5 of the flowchart shown in FIG. 3.

FIG. 5 is a flowchart illustrating a subroutine for the heater power ON timing obtaining process.

First, a process time α of the non-print mode process to be executed is obtained (step S21). The process time can be obtained by referring to the non-print mode process time table (FIG. 6A) stored in the non-print mode process time storage unit 456 (FIG. 2).

Subsequently, a target temperature Ta of the fixing roller 41 is obtained, wherein the target temperature Ta is a temperature that is targeted to be reached by the fixing roller 41 at the end of the non-print mode process (step S22).

The target temperature Ta is basically a temperature maintained at the start of the non-print mode process by the temperature adjustment control. That is to say, for example, when the wait temperature is maintained at the start of the non-print mode process by the temperature adjustment control, the target temperature Ta is set to the wait temperature.

Also, when the non-print mode process is started by stopping the print process, the target temperature is set to the fixable temperature so that the print process can be restarted immediately after the non-print mode process ends.

As an exceptional case, when a print job is received during a period between a start of the non-print mode process switched from the wait state and a switch to the heater power ON, the target temperature Ta is set to the fixable temperature.

The ROM 454 stores a table, such as the one illustrated in FIG. 6B, that specifies target temperature Ta for either of the case where a print mode process is executed after a non-print mode process ends and the case where no print mode process is executed after a non-print mode process ends. The CPU 451 obtains the target temperature Ta by referring to the table.

Next, a temperature rise velocity Vu of the fixing roller 41 in the heater power ON is obtained, wherein the temperature rise velocity Vu is a temperature rise per unit time (° C./sec) (step S23). The temperature rise velocity Vu is determined as an average of values obtained by preliminary measurements in experiments, and is stored in the ROM 454.

Alternatively, the temperature rise velocity Vu may be obtained automatically from the relationship between the elapse time and the change in the surface temperature of the fixing roller 41 detected by the temperature sensor 43 during the warm-up at the start-up of the device, and the temperature rise velocity Vu may be stored in the EEPROM 455. This realizes a more accurate temperature control because the temperature rise velocity is affected also by the environmental temperature of the device and the state of the power source in the device installation location.

Subsequently, an equation is provided, the equation defining a correlation between a fixing unit temperature T (° C.) and a time t (sec) during the temperature rise control that is performed to have the fixing unit temperature T reach the target temperature Ta at the end of the non-print mode process, wherein t denotes an elapse time from the heater power OFF and T denotes the surface temperature of the fixing roller 41 (the fixing unit temperature) (step S24).

Here, let α (sec) denote a general time required for executing the non-print mode process, then the correlation for the temperature T to reach the target temperature Ta after an elapse of the time α is expressed by the following general equation (1):

$$T=Vu(t-\alpha)+Ta \quad (1)$$

Figure 7:
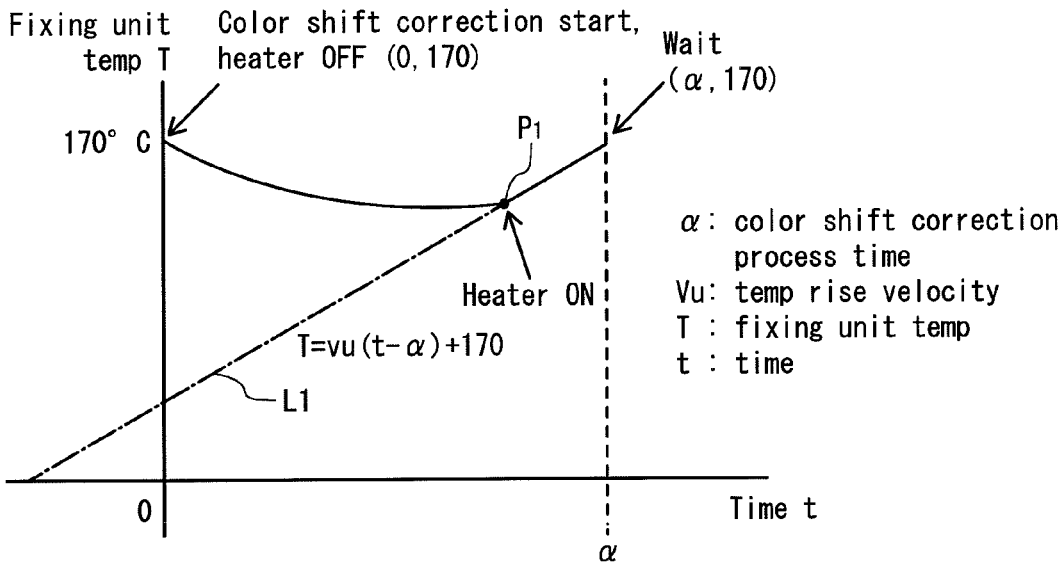
FIG. 7 illustrates a first example of the change in the fixing unit temperature during the temperature control performed in the fixing device during execution of a non-print mode process.

FIG. 7 is a graph illustrating the change in the fixing unit temperature T when the color shift correction process is executed as the non-print mode process, and an example of the timing at which the heater power ON is started.

In the graph, the horizontal axis represents the elapse time t from the start of the execution of the non-print mode process, and the vertical axis represents the fixing unit temperature T detected by the temperature sensor 43.

Also, in the graph, "heater power OFF" and "heater power ON" are merely recited as "heater OFF" and "heater ON", respectively for the sake of convenience. This applies to other similar graphs to be described hereinafter.

In this example, the fixing unit temperature T at the start of the color shift correction process is set to the wait temperature, 170° C., and the target temperature Ta that is to be restored at the end of the color shift correction process is also set to the wait temperature, 170° C.

A straight line L1 represents the increase of the temperature T to the wait temperature 170° C. over the time α (temperature rise control straight line), and from the above equation (1), the increase is expressed by the following equation.

$$T=Vu(t-\alpha)+170$$

When the heater is powered OFF approximately at the same time as the start of the color shift correction process, the fixing unit temperature T gradually falls, as shown in FIG. 7. However, if the heater is powered ON at the time of a point P1 where the temperature line intersects with the straight line L1, the fixing unit temperature T can be restored to the wait temperature 170° C. at the end of the color shift correction process (time α).

Accordingly, the time included in the coordinates of the intersection point P1 indicates the timing at which the heater power is to be switched ON.

Figure 8:
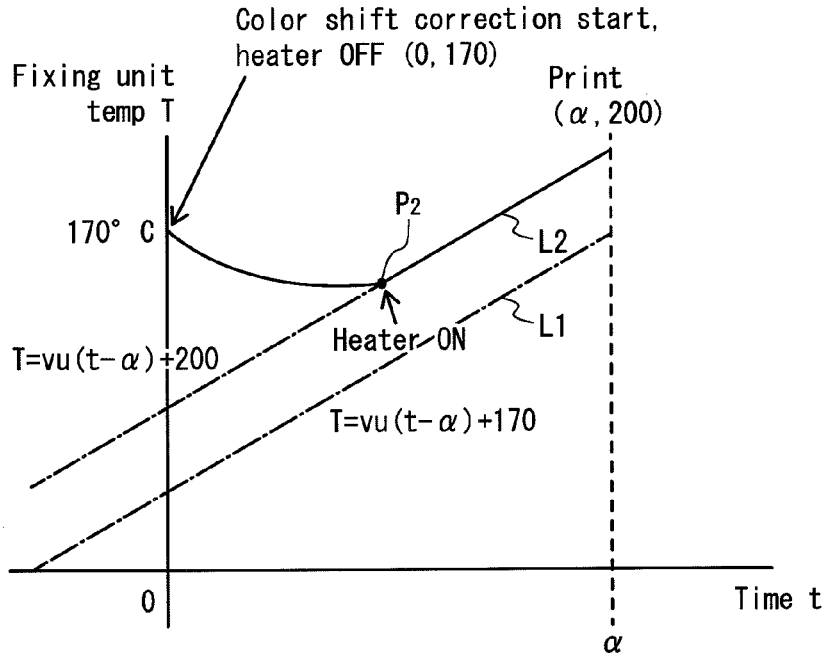
FIG. 8 illustrates a second example of the change in the fixing unit temperature during the temperature control performed in the fixing device during execution of a non-print mode process.

FIG. 8 illustrates another example in which the fixing unit temperature T at the start of the color shift correction process is set to the wait temperature, 170° C., and the target temperature Ta that is to be restored at the end of the color shift correction process, and to which the fixing unit temperature T needs to be increased, is set to the fixable temperature, 200° C.

A straight line L2 is a temperature rise control straight line in the case where the temperature T is increased to the fixable temperature 200° C. over the time α, and from the above equation (1), the increase is expressed by the following equation.

$$T=Vu(t-\alpha)+200$$

When the heater is powered OFF approximately at the same time as the start of the color shift correction process, the fixing unit temperature T gradually falls, as shown in FIG. 8. If a print job is received thereafter, it is necessary to execute the print job as soon as possible. In that case, if the heater is powered ON at the time of a point P2 where the temperature line intersects with the straight line L2, the fixing unit temperature T can be restored to the fixable temperature 200° C. at the end of the color shift correction process, namely after an elapse of the time α. This makes it possible to execute the print job quickly, thus preventing the user from waiting unnecessarily.

Note that, if a print job is received after the time of the intersection point P2, the heater is immediately powered ON to raise the temperature, without waiting for the time to reach the point P1 (FIG. 7) where the temperature line intersects with the straight line L1.

Figure 9:
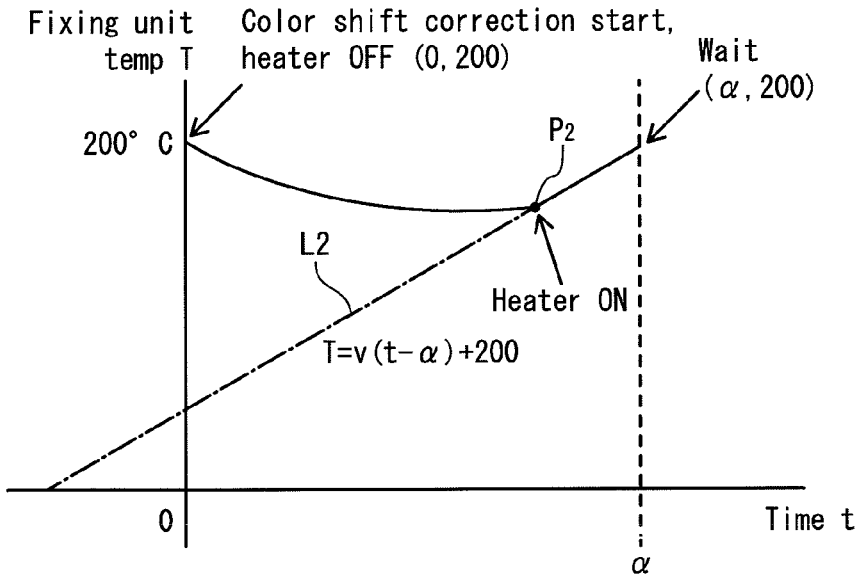
FIG. 9 illustrates a third example of the change in the fixing unit temperature during the temperature control performed in the fixing device during execution of a non-print mode process.

FIG. 9 illustrates a further example of the temperature control in which a print job is stopped to execute the color shift correction process, and the print job is resumed after the execution of the color shift correction process, and the fixing unit temperature T at the start of the color shift correction process and the target temperature Ta that is to be restored at the end of the color shift correction process are both set to the fixable temperature, 200° C.

When the print job is stopped and the heater is powered OFF approximately at the same time as the start of the color shift correction process, the fixing unit temperature T gradually falls. However, if the heater is powered ON at the time of a point P2 where the temperature line intersects with the straight line L2, the fixing unit temperature T can be restored to the fixable temperature 200° C. at the end of the color shift correction process, namely after an elapse of the time α. This makes it possible to resume the print job immediately.

As described above, the time at the intersection point, where the temperature fall curve of the fixing unit temperature T after the heater power OFF intersects with the temperature rise straight line (L1 or L2), can be determined as the timing at which the heater is to be powered ON.

This intersection point can be obtained by approximating a temperature fall curve by a straight line, creating an equation thereof, and solving the system of equations that contains the straight line and the equation (1) (see Modification (1) described below). However, in the present embodiment, the method shown in step S25 of FIG. 5 is adopted for the purpose of obtaining the timing more accurately without using an approximate expression of the straight line.

That is to say, values of the fixing unit temperature T are sampled at predetermined intervals after the heater is powered OFF, and the time at which the relationship "T≤Vu (t−α)+Ta" is satisfied for the first time is determined as the timing of the heater power ON (step S25). It is needless to say that the shorter the interval between the samplings is, the more accurate the obtained timing of the heater power ON is.

This completes explanation of the subroutine for the heater power ON timing obtaining process, and the description returns to the flowchart of FIG. 3.

In step S6 of FIG. 3, it is judged whether or not the heater power ON timing obtained in the above-described process of step S5 has been reached, and if it is judged that the heater power ON timing has been reached (YES in step S6), the heater power is switched ON (step S7), and it is monitored whether or not the temperature of the fixing roller 41 has reached the target temperature Ta (step S8).

If it is judged that the temperature of the fixing roller 41 has reached the target temperature Ta (YES in step S8), the temperature control during execution of non-print mode process ends. The control then returns to the main flowchart, and the temperature adjustment control for the target temperature Ta is executed.

Note that, if it is judged in step S1 that an execution of the non-print mode process has not been started, or if it is judged in step S2 that the heater power OFF is not available (NO in step S3), the temperature adjustment control is performed to maintain the currently set temperature (step S9), and the control returns to the main flowchart.

As described above, according to the present embodiment, the heater power is switched OFF as much as possible to save power when the non-print mode process is executed, the fixing unit temperature T is restored to the fixable temperature when a print job is to be executed immediately after the non-print mode process ends, and otherwise the fixing unit temperature T is restored to the wait temperature. This structure of the present embodiment makes it possible to execute the subsequent print job quickly, preventing the user from waiting unnecessarily, and thus highly contributes to convenience of the user.

<Modifications>

Up to now, one aspect of the present invention has been described based on the embodiment. However, the present invention is not limited to the above-described embodiment in technical range, but may be modified as follows, for example.

(1) In the above embodiment, the heater power is switched OFF whenever the non-print mode process is executed, except for the case where the process time of the non-print mode process is uncertain (see the flowchart of the heater power OFF availability judging process shown in FIG. 4). However, in the temperature adjustment control for the halogen heater 44 as in the present embodiment, normally, the ON/OFF control of the heater power is repeated at short intervals so that the temperature is kept to be in a predetermined range. In that case, the power saving effect may hardly be produced if the process time of the non-print mode process is shorter than a predetermined time period.

Figure 10:
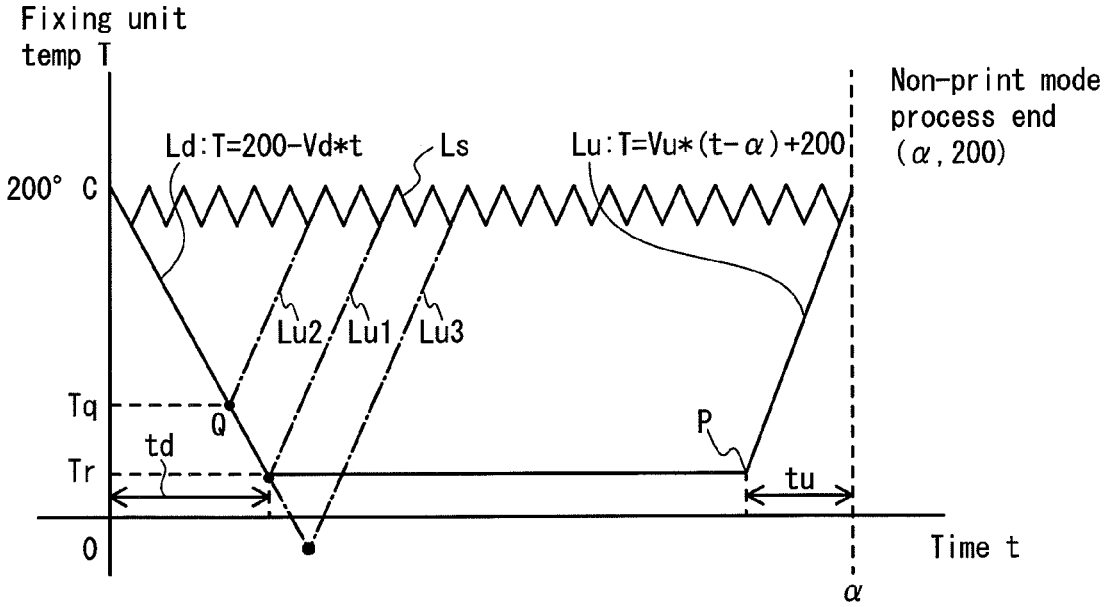
FIG. 10 schematically illustrates the relationship between the non-print mode process time and the power saving effect.

FIG. 10 schematically illustrates the changes in the fixing unit temperature T, for explanation of the above.

FIG. 10 illustrates, as one example, a case where a print job is stopped to execute the non-print mode process, and the fixing unit temperatures T at the start and end of the non-print mode process are both set to the fixable temperature, 200° C.

A zigzag line Ls extending in the horizontal direction represents, with slight exaggeration, the changes in temperature of the fixing roller 41 when the temperature adjustment control is performed by setting the target temperature to 200° C.

In the actuality, the temperature control is performed as follows: if the surface temperature T of the fixing roller 41 detected by the temperature sensor 43 (the fixing unit temperature T) rises above 200° C., the heater power is switched OFF; and if the fixing unit temperature T falls below 200° C., the heater power is switched ON. In this way, the ON/OFF control of the heater power is repeated at short intervals so that the fixing unit temperature T is kept to be in a range of fixable temperatures around 200° C., and ripples are observed to be generated due to response speeds of the temperature sensor 43 and the like.

On the other hand, a straight line Ld approximates a temperature fall curve during the heater power OFF (in which the power is kept to be off continuously), and the equation of the straight line Ld is expressed as "T=200−Vd *t", wherein Vd denotes a temperature fall velocity (a temperature fall per unit time (° C./sec)).

In the case where the process time α of the non-print mode process is sufficiently long, when the heater is powered OFF approximately at the same time (time t=0) as the start of the non-print mode process for the sake of power saving, the fixing unit temperature T falls down along the straight line Ld, but it does not fall down below a normal temperature Tr.

Here, the normal temperature means an environmental temperature of the location where the printer 1 is installed. In normal circumstances, a ventilation fan is installed in the printer 1, thus if the halogen heater 44, which is the largest heat source in the device, is powered OFF, the temperature in the device falls down to be close to the environmental temperature but not to be below it, and the fixing unit temperature T does not fall down below the environmental temperature, either.

In most cases, the printer 1 is used in an air-conditioned space such as an office room. Accordingly, the normal temperature Tr is set to be in a range approximately from 10° C. to 30° C., which is a normal range of air-conditioned temperatures. A user or an administrator of the printer 1 may set the normal temperature Tr to an appropriate value by using the operation panel 35 as reception means, taking account the actual use environment, the season and/or the like. Alternatively, a temperature sensor for detecting a temperature of the surrounding of the device may be installed outside the device or at an inlet for taking the outer air into the device, and the temperature detected by the temperature sensor may be stored in the RAM 453 or the EEPROM 455 as the normal temperature Tr.

In the case where the process time α of the non-print mode process is sufficiently long, the fixing unit temperature T continues to be the normal temperature Tr for a while, and then at a time of a point P where the temperature line intersects with a temperature rise straight line Lu (T=Vu (t−α)+200), the heater power is switched ON and the fixing unit temperature T rises up along the straight line Lu.

However, in the case where the process time α of the non-print mode process is short, the straight line Lu is shifted leftward in the drawing. For example, suppose that the straight line Lu is shifted to the position of a straight line Lu1. In that case, the fixing unit temperature T falls down along the straight line Ld and as soon as it reaches the normal temperature Tr, it starts to rise up along the straight line Lu1 and rises up until it reaches 200° C. As apparent from this, when the straight line Lu is the straight line Lu1 or Lu2, a total time of power ON in the ON/OFF control of the heater power that is, as in the zigzag line Ls, repeated at short intervals so that the temperature is kept to be in a range of fixable temperature is approximately the same as a time period for which the heater power is kept to be ON continuously; and a total time of power OFF in the ON/OFF control of the heater power as in the zigzag line Ls is approximately the same as a time period for which the heater power is kept to be OFF continuously.

That is to say, when the time td represents a time required for the fixing unit temperature T to fall from 200° C. to the normal temperature Tr and the time tu represents a time required for the fixing unit temperature T to rise from the normal temperature Tr to 200° C., the power saving effect is obtained only when the sum of the time td and the time tu is smaller than the process time α of the non-print mode process. Otherwise, the power saving effect can hardly be obtained.

It is considered that, for the above case where the power saving effect can hardly be obtained, there is no need to perform such a complicated control of switching the heater power OFF and then switching the heater power ON to return to the original temperature. For such a case, it would rather be preferable to continue to maintain the fixable temperature. This is because it accumulates heat in the fixing unit 40, especially in a pressing roller 42 provided in the fixing unit 40, preventing a fixing failure from occurring even when a large amount of print processes are executed in succession immediately after the process time of the non-print mode process elapses, and thus contributing to the convenience for the users.

Accordingly, in the present modification, the process time of the non-print mode process is compared with a predetermined time period, and the judgment on whether or not the heater power should be switched OFF is made only when it is apparent, based on the comparison result, that the power saving effect can be obtained.

Figure 11:
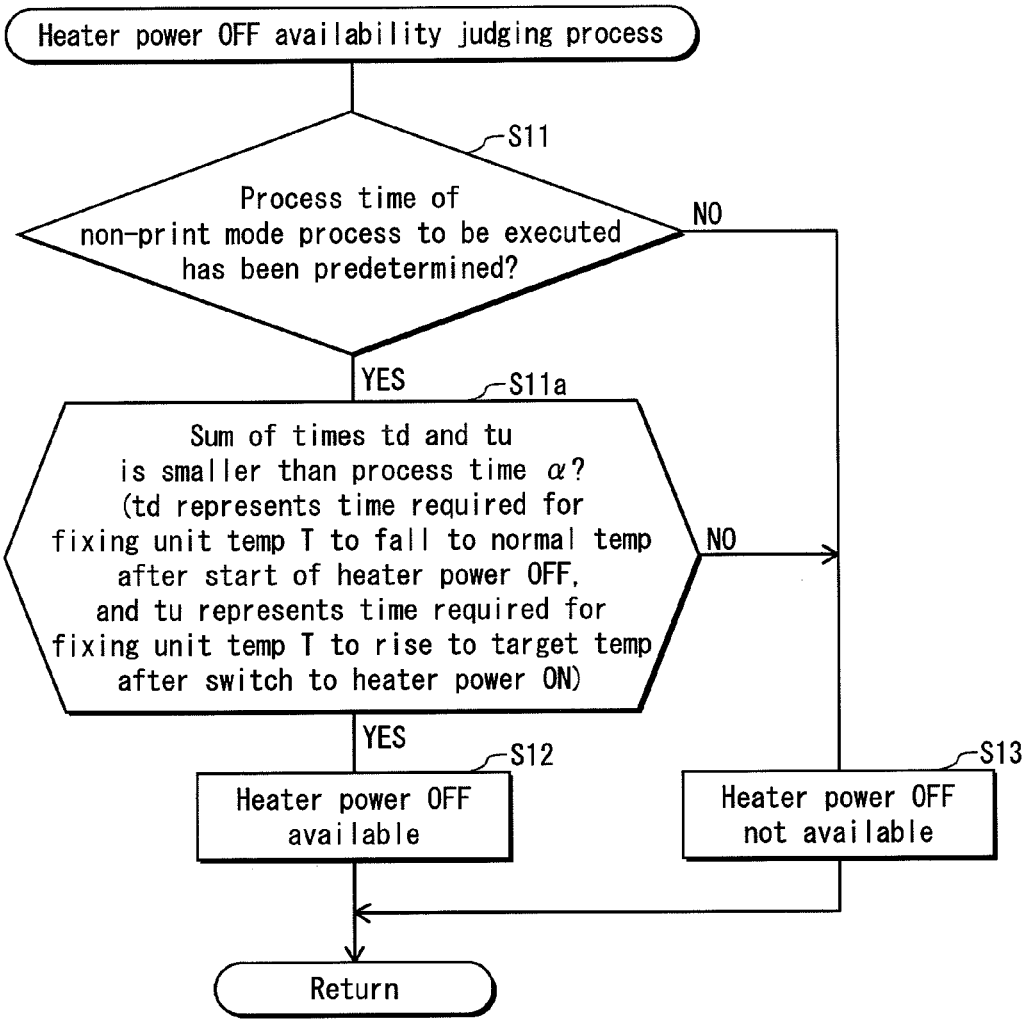
FIG. 11 is a flowchart illustrating a subroutine for the heater power OFF availability judging process performed in step S2 of the flowchart shown in FIG. 3 in a modification.

In this case, the flowchart of the heater power OFF availability judging process illustrated in FIG. 4 is modified as illustrated in FIG. 11.

First, it is judged, by referring to the non-print mode process time table stored in the non-print mode process time storage unit 456 (FIG. 6A), whether or not the process time of the non-print mode process to be executed has been predetermined (step S11).

If it is judged that the process time of the non-print mode process to be executed has been predetermined (step S11: YES), the control proceeds to step S11*a* in which it is judged whether or not the sum of the times td and tu is smaller than the process time α, wherein the time td represents a time required for the fixing unit temperature T to fall to the normal temperature after the start of heater power OFF, and the time tu represents a time required for the fixing unit temperature T to rise to a target temperature (which is the wait temperature or the fixable temperature and is obtained by referring to the table illustrated in FIG. 6B) after the heater power is switched ON.

The times td and tu can be obtained easily as follows: the time td is obtained by substituting an equation "T=Tr" into the equation of the straight line Ld; and the time tu is obtained by subtracting a value, which is obtained by substituting the equation "T=Tr" into the equation of the straight line Lu, from the value α.

If it is judged that the time (td+tu) is smaller than the process time α (that is to say, when the process time α is greater than the time (td+tu)) (YES in step S11*a*), it is determined as "heater power OFF available" (step S12). On the other hand, if it is judged that the time (td+tu) is equal to or greater than the process time α (that is to say, when the process time α is equal to or smaller than the time (td +tu)) (NO in step S11*a*), it is determined as "heater power OFF not available" (step S13) since the power saving effect is hardly produced, and priority is given to the convenience provided by the preheating.

For example, when the temperature rise velocity Vu is 10 (° C./sec), the temperature fall velocity Vd is 20 (° C./sec), the normal temperature Tr is 20° C., the fixing unit temperature T at the start of the non-print mode process is 200° C., and the target temperature Ta at the end of the non-print mode process is 200° C., it takes 18 seconds for the fixing unit temperature T to fall down to the normal temperature Tr after the heater power OFF, and 9 seconds to rise up to 200° C. after the heater power ON, and thus the time (td+tu) is 27 seconds.

Accordingly, in this case, if the process time α of the non-print mode process is equal to or smaller than 27 seconds, it is determined as "heater power OFF not available" and the temperature adjustment control is continued to maintain the fixable temperature 200° C.

(2) In the above modification (1), it is decided, based on the result of comparison between the values of the time (td+tu) and process time α, whether or not the heater power should be switched OFF. However, the same decision can be made by performing a judgment on whether or not a fixing unit temperature Tq at an intersection point Q, where the straight line Ld intersects with the straight line Lu, is smaller than the normal temperature Tr, as can be deduced from FIG. 10.

This is because: when the process time α of the non-print mode process is equal to or smaller than the time (td+tu), the temperature rise straight line Lu is shifted leftward in FIG. 10 to the straight line Lu1 or Lu2, and a fixing unit temperature Tq at the intersection point Q is equal to or larger than the normal temperature Tr; and when the process time α of the non-print mode process is greater than the time (td+tu), the temperature rise straight line Lu is shifted in FIG. 10 to the straight line Lu3, and the fixing unit temperature Tq at the intersection point Q is smaller than the normal temperature Tr.

Figure 12:
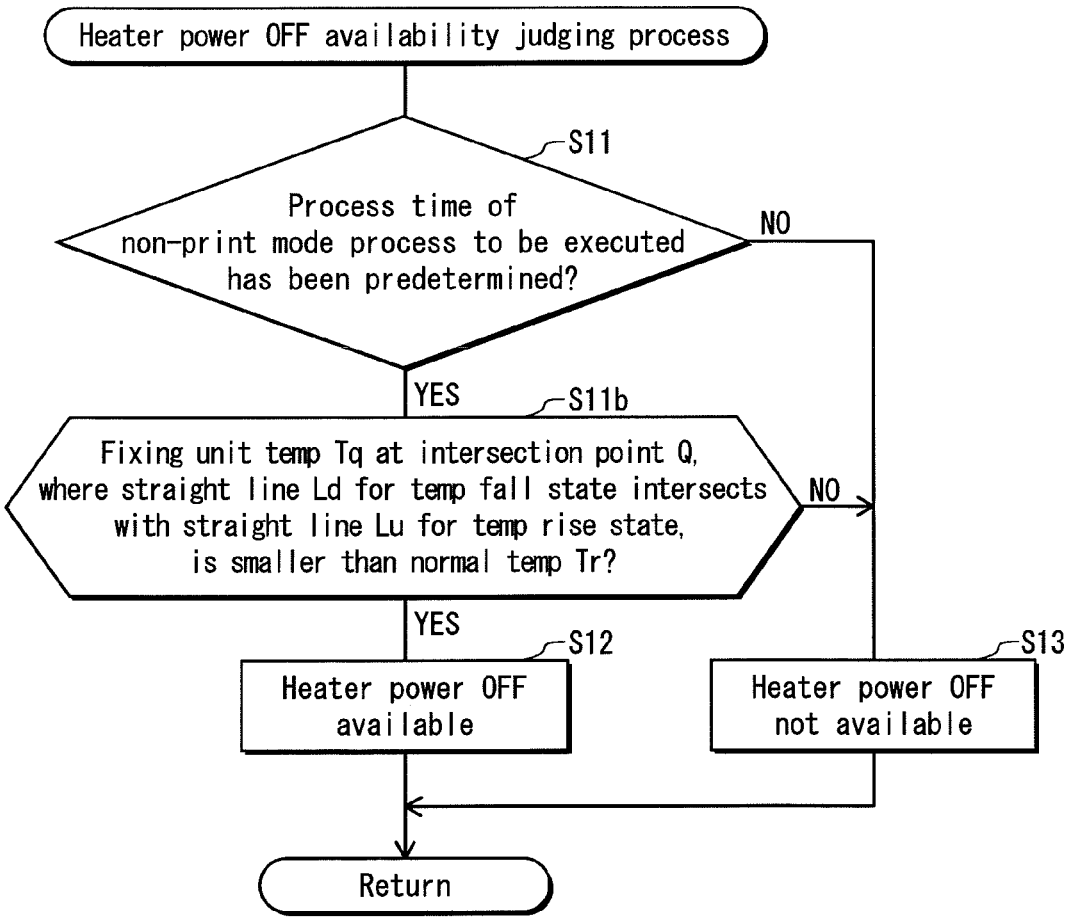
FIG. 12 is a flowchart illustrating a subroutine for the heater power OFF availability judging process performed in step S2 of the flowchart shown in FIG. 3 in another modification.

In this case, as shown in the flowchart of FIG. 12, instead of step S11*a* in FIG. 11, step S11*b* is performed, in which it is judged whether or not the fixing unit temperature Tq at the intersection point Q is smaller than the normal temperature Tr.

Here, let T1 denote the fixing unit temperature T at the start of a non-print mode process, and let T2 denote a temperature to which the fixing unit temperature T is to be restored at the end of the non-print mode process, then a temperature fall straight line Ld and a temperature rise straight line Lu are respectively expressed by the following equations:

$$T=T1-Vd*t$$

$$T=Vu(t-\alpha)+T2$$

wherein α denotes the process time of the non-print mode process, Vd denotes the temperature fall velocity, and Vu denotes the temperature rise velocity.

As a solution to a system of these equations, the fixing unit temperature Tq at the intersection point Q is obtained as the following equation (2).

$$Tq=(T1*Vu+T2*Vd-Vd*Vu*\alpha)/(Vd+Vu) \quad (2)$$

Accordingly, when the fixing unit temperature Tq at the intersection point Q is smaller than the normal temperature Tr (YES in step S11*b*), it is judged as "heater power OFF available" (step S12); and when the fixing unit temperature Tq at the intersection point Q is equal to or larger than the normal temperature Tr (NO in step S11*b*), it is determined as "heater power OFF not available", with priority being given to the convenience provided by the preheating (step S13)

Also, when the equation (2) is solved for a on the condition that Tq=Tr, the following equation (3) is obtained.

$$\alpha=(T1*Vu+T2*Vd-Tr*(Vd+Vu))/(Vd*Vu) \quad (3)$$

Here, let a time Tt denote the right side of the equation (3), then it is determined as "heater power ON available" when the non-print mode process time α is longer than a predetermined time Tt; and it is determined as "heater power ON not available" when the non-print mode process time α is equal to or shorter than the predetermined time Tt.

(3) If a failure of a specific non-print mode process is detected during an execution of the process and the process is executed again from the beginning, the heater power ON timing obtaining process performed in step S5 of FIG. 3 is executed as follows.

Figure 13:
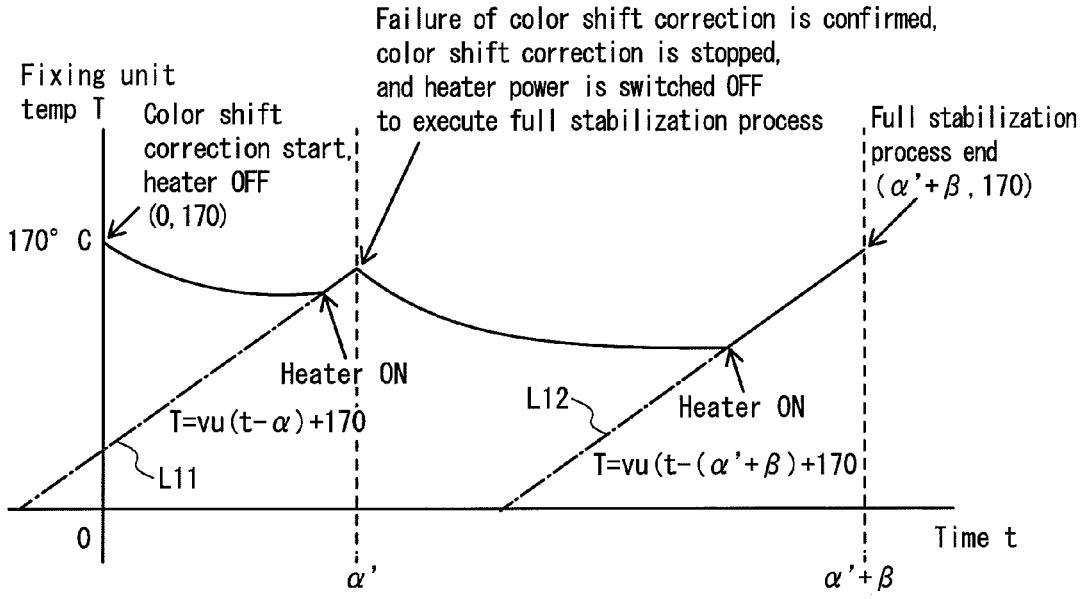
FIG. 13 illustrates the change in the fixing unit temperature T and the heater power ON timing in the case where the full stabilization process is executed after the color shift correction process results in a failure.

FIG. 13 illustrates an example of the temperature control performed in this case, wherein the non-print mode process executed in this example is the color shift correction process.

Note that the fixing unit temperature T at the start of the color shift correction process and the target temperature Ta that is to be restored at the end of the color shift correction process are both set to 170° C.

First, the heater is powered OFF approximately at the same time as the start of the color shift correction process. The fixing unit temperature T gradually falls, and then when the temperature line intersects with the straight line L11 (T=Vu (t−α)+170), the heater power is switched ON to increase the temperature. Then if it is confirmed, at time α', a time before time α at which the color shift correction process is scheduled to be ended, that the color shift correction process has resulted in a failure, the color shift correction process is stopped.

Such a failure of a color shift correction may occur mainly when a detection of a resist pattern by the photoelectric sensor 23 results in a failure. Especially, when the temperature and/or humidity in the device changes greatly after the previous color shift correction process, and the density of one or more colors becomes too low and the resist patterns cannot be detected, the amount of shift of resist pattern in each color cannot be measured appropriately, and thus the color shift cannot be corrected.

Accordingly, whether or not the color shift correction has failed can be confirmed as follows. For example, it is judged that the color shift correction has resulted in a failure, when a resist pattern was formed on the intermediate transfer belt 21, but the photoelectric sensor 23 does not obtain a detection signal of a specific color, or, if it obtains, the lines of the obtained detection signal are irregular in width. Also, it is judged that the color shift correction has resulted in a failure, when a calculated amount of positional shift is an extremely large value that any normal device would not have.

In the above case, it is necessary to execute the process again starting with the color density adjustment process. Accordingly, the full stabilization process, in which the color density adjustment process and the color shift correction process are executed in succession, is executed.

Thus, when it is judged that the color shift correction process has resulted in a failure (at time α'), the color shift correction process is stopped immediately, the full stabilization process is executed, and approximately at the same time, the heater power is switched OFF.

Here, let β denote a time required for executing the full stabilization process, then the temperature rise straight line L12 for the case where the full stabilization process ends at time (α'+β) and the fixing unit temperature T is restored to the wait temperature 170° C., is expressed as follows.

$$T=Vu(t-(\alpha'-\beta))+170$$

Accordingly, with the structure, the heater is powered OFF at time α', then the fixing unit temperature T gradually falls, and at a timing when the temperature line intersects with the straight line L12, the heater power is switched ON, so that the fixing unit temperature T is restored to the wait temperature 170° C. at the end of the full stabilization process, and then a reception of the succeeding print job is awaited.

Figure 14:
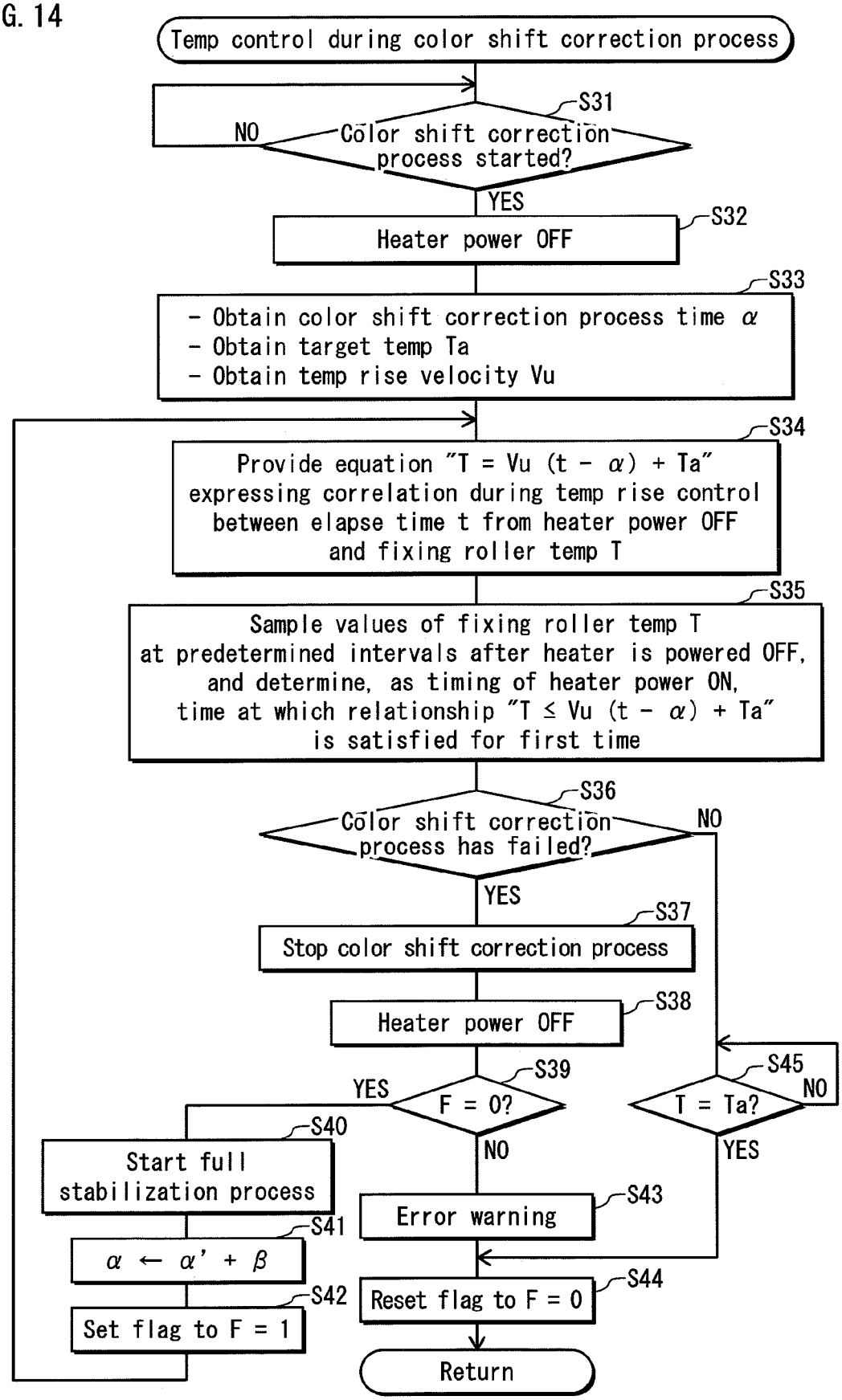
FIG. 14 is a flowchart illustrating a subroutine for the heater power ON timing obtaining process performed in the case of FIG. 13.

FIG. 14 is a flowchart of the temperature control performed by the controller 45 in the above case.

First, in step S31, it is judged whether or not the color shift correction process is started, and if it is judged that the color shift correction process is started (YES in step S31), the heater power is switched OFF (step S32), and the process time $\alpha$ of the color shift correction process to be executed, the target temperature Ta to which the fixing roller 41 should reach at the end of the color shift correction process, and the temperature rise velocity Vu of the fixing roller 41 while the heater power is ON are obtained (step S33).

In step S34, the equation ($T=Vu(t-\alpha)+Ta$) for the temperature rise straight line L11 (FIG. 13) is obtained.

Subsequently, the fixing unit temperature T after the heater power OFF is sampled at regular intervals, and at a timing when the condition "$T \leq Vu(t-\alpha)+Ta$" is satisfied for the first time, the heater power is switched ON (step S35).

Next, it is judged whether or not the color shift correction process has failed (step S36). If it is judged that the color shift correction process has failed (YES in step S36), the color shift correction process is stopped, and the heater power is switched OFF (steps S37, S38).

It is judged then whether or not F=0 (step S39). Note that, when this flag is F=0, it indicates that the failure of the color shift correction process is the first one, namely, a failure that occurred for the first time; and when this flag is F=1, it indicates that the failure is the second one, namely, a failure that occurred for the second time. The state of the flag is stored, for example, temporarily in the RAM 453.

If it is judged that F=0 (YES in step S39), the full stabilization process is started (step S40), value ($\alpha'+\beta$) is set to the value $\alpha$ (step S41), and the flag is set to "F=1" (step S42).

Note that $\alpha'$ denotes a time at which it was judged that the failure of the color shift correction process is the first failure, and $\beta$ denotes a time period required for the full stabilization process to be completed.

The control then returns to step S34 in which the equation for the straight line L12 (FIG. 13) is obtained by substituting ($\alpha'+\beta$) for $\alpha$, and based on the new straight line L12, values of the fixing unit temperature T are sampled at predetermined intervals and a timing for switching the heater power ON is obtained, and the heater power is switched ON again at the obtained timing (step S35).

After this, if a failure of the color shift correction process in the full stabilization process is found (YES in step S36), the color shift correction process is immediately stopped, and the heater power is switched OFF (steps S37, S38). In the next step (step S39), it is judged whether or not F=0, and at this round, the flag has been set to "F=1" in step S42, and thus it is judged as "NO" in step S39, and the control proceeds to step S43 in which an error warning is made.

More specifically, this error warning is realized by displaying on the liquid crystal display of the operation panel 35 a message that the color shift correction process has failed, or by emitting a warning sound in addition to or instead of displaying the warning.

Subsequently, the flag is reset to "F=0" (step S44), and the control returns to the main flowchart.

On the other hand, if it is judged that the color shift correction process has not failed (NO in step S36), the heater power ON is continued, and then when the fixing unit temperature T reaches the target temperature Ta (T=Ta) (YES in step S45), the flag is reset to "F=0" (step S44), and the control returns to the main flowchart.

Note that in this modification, the case where a failure of the color shift correction process is detected during the process is taken as an example, but the present invention is also applicable, for example, to a case where, if a failure of another non-print mode process is detected during its execution, the non-print mode process or, as an alternative to it, another non-print mode process is executed.

For example, the present invention is applicable to a case where, during the color density adjustment process, it is detected that, with regard to a certain color, the color density adjustment has failed and the color density adjustment process needs to be executed again.

(4) In the modification (3) above, as in the modification (1) above, it is possible to execute a step for judging whether or not the heater power OFF is available, by comparing the process time of the non-print mode process with a predetermined time period.

Figure 15:
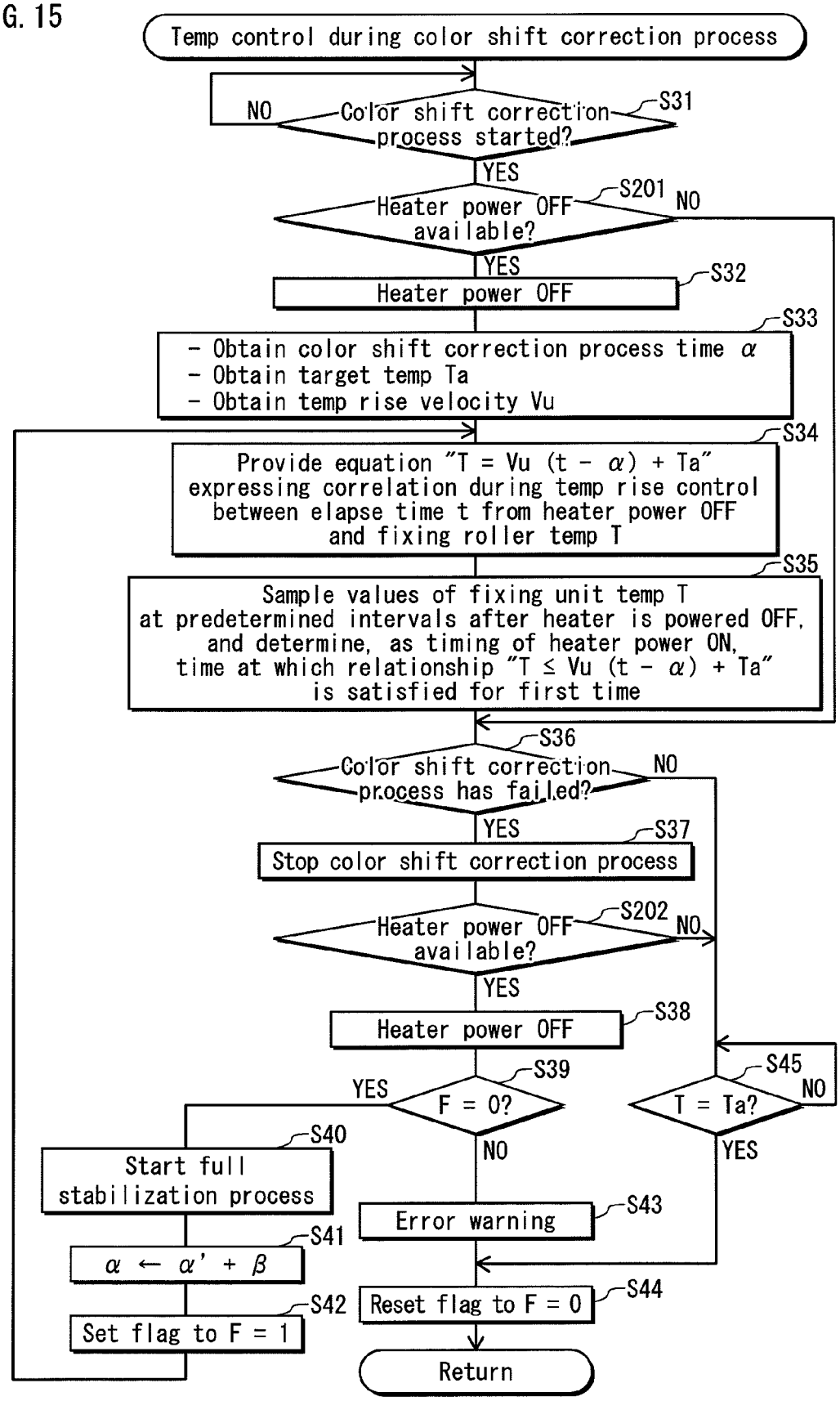
FIG. 15 is a flowchart of a modification having the heater power OFF availability judging process in addition to the flowchart of FIG. 14.

FIG. 15 is a flowchart of the temperature control in the above case performed during the color shift correction process. As shown therein, FIG. 15 greatly differs from FIG. 14 for modification (3) in that steps S201 and S202 are inserted between steps S31 and S32 and between steps S37 and S38, respectively.

First, if it is judged in step S31 that the color shift correction process is started (YES in step S31), it is judged whether or not the heater power OFF is available (step S201). More specifically, as has been explained with reference to FIG. 11, if the process time of the color shift correction process is greater than a predetermined time, it is judged that the heater power OFF is available; and if the process time of the color shift correction process is equal to or smaller than the predetermined time, it is judged that the heater power OFF is not available.

If it is judged in step S201 that the heater power OFF is available (YES in step S201), the heater power is switched OFF (step S32), and the process proceeds to step S36 in the same manner as the process of FIG. 14.

If it is judged in step S201 that the heater power OFF is not available (NO in step S201), the temperature control is continued without switching OFF the heater power and the control proceeds to step S36.

In step S36, it is judged whether or not the color shift correction process has failed (step S36). If it is judged that the color shift correction process has failed (YES in step S36), the color shift correction process is stopped (step S37), and it is judged, with regard to a non-print mode process to be executed next, whether or not the heater power OFF is available (step S202). That is to say, if the process time of the non-print mode process to be executed next (the full stabilization process) is greater than the predetermined time, it is judged that the heater power OFF is available; and if the process time is equal to or smaller than the predetermined time, it is judged that the heater power OFF is not available.

If it is judged that the heater power OFF is available (YES in step S202), the heater power is switched OFF (step S38), and step S39 and subsequent steps are executed.

If it is judged that the heater power OFF is not available (NO in step S202), the control proceeds to step S45, in which it is judged whether or not the fixing unit temperature T has reached the target temperature Ta. More specifically, here, if the heater power was switched OFF previously and the current fixing unit temperature T is smaller than the target temperature Ta, it is waited for the fixing unit temperature T to rise up to the target temperature Ta; and if the heater power was not switched OFF previously and the fixing unit temperature T has been adjusted to be the target temperature Ta, the control proceeds to the next step.

The flowchart of FIG. 15, as with the flowchart of FIG. 14, deals with the case where the color shift correction process results in a failure and the full stabilization process is executed, with extension of the process time for the non-print mode. In general, the present invention is applicable to the case where the first non-print mode process results in a failure and the second non-print mode process (which may be or may not be the same as the first one) is executed in succession. This structure, where it is judged whether or not the heater power OFF is available at the start of each of the non-print mode processes, provides execution of the non-print mode that is convenient for the users.

(5) In the thick paper print mode in which printing is made onto thick paper, it is preferable to preheat the fixing unit 40.

The reason is as follows. In the thick paper print mode, a more amount of heat is removed from the fixing roller 41 than when printing is made onto regular paper. Accordingly, if sheets of thick paper are subjected to the fixing process in succession, the temperature of the fixing roller 41 decreases at a rapid pace, and a fixing failure might occur. In view of this, a preheat process is executed. In the preheat process, the fixing roller 41 is preliminarily heated to a fixable temperature and is rotated for a predetermined time period, so that the pressing roller 42 and the like are heated sufficiently as well and some amount of heat is accumulated in the fixing unit 40.

Here, let $\gamma$ denote a time required for executing the preheat process. The manner of the temperature control during the non-print mode process varies depending on the relationship in size between the preheat time $\gamma$ and the process time $\alpha$ of the non-print mode process to be executed.

FIGS. 16A and 16B are graphs showing an example of the temperature control in which a thick paper print mode process is stopped to execute the color shift correction process, and the thick paper print mode process is resumed after the execution of the color shift correction process. FIG. 16A illustrates how the temperature control is performed in the case where the process time $\alpha$ of the color shift correction process is larger than the preheat time $\gamma$ ($\alpha>\gamma$). FIG. 16B illustrates how the temperature control is performed in the case where the process time $\alpha$ of the color shift correction process is equal to or smaller than the preheat time $\gamma$ ($\alpha\leq\gamma$).

In the case of FIG. 16A, the heater power is switched OFF approximately at the same time as the color shift correction process is started. However, since the preheating needs to be completed before the end of the color shift correction process ($t=\alpha$), the fixing unit temperature T needs to be restored to the fixable temperature 200° C. by time ($\alpha-\gamma$).

Accordingly, the equation for a temperature rise control straight line L21 is expressed as:

$$T=Vu(t-(\alpha-\gamma))+200$$

When the fixing unit temperature T gradually falls down and reaches a position where the temperature line intersects with the temperature rise control straight line L21, the heater power is switched ON and the fixing unit temperature T is restored to the fixable temperature 200° C. by time ($\alpha-\gamma$). The color shift correction process ends approximately at the same time as the preheat time $\gamma$ elapses, which enables the thick paper print mode to be resumed immediately.

On the other hand, in the case where the process time $\alpha$ of the color shift correction process is equal to or smaller than the preheat time $\gamma$ ($\alpha\leq\gamma$), if the heater power is switched OFF, the preheating is not completed before the end of the color shift correction process. Thus in this case, as shown in FIG. 15B, the temperature adjustment control is performed not to switch OFF the heater power and to maintain the fixable temperature 200° C. during the color shift correction process.

Subsequently, the thick paper print mode is resumed after the preheat time $\gamma$ elapses.

Figure 17:
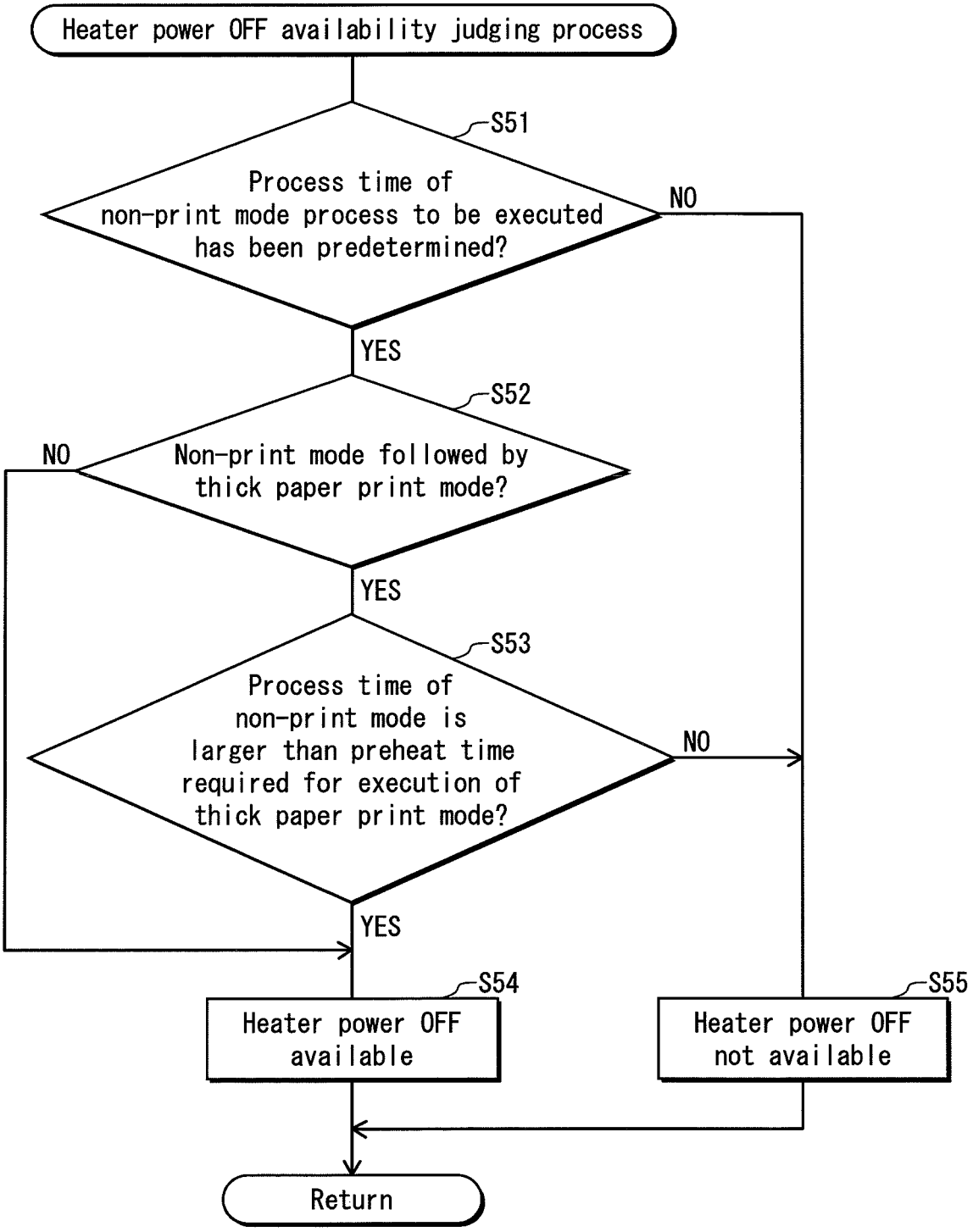
FIG. 17 is a flowchart illustrating a subroutine for the heater power OFF availability judging process in the case of FIGS. 16A and 16B.

FIG. 17 is a flowchart of the control performed by the controller 45 in the heater power OFF availability judging process during the execution of the present modification.

First, it is judged whether or not the process time of the non-print mode process to be executed has been predetermined, by referring to the non-print mode process time table stored in the non-print mode process time storage unit 456 (step S51). If it is judged that the process time has been predetermined (YES in step S51), it is judged whether or not the thick paper print mode process is to be executed after the present non-print mode process (step S52).

For example, in the above case where the thick paper print mode process is stopped and a non-print mode process is executed, the control is performed so that the thick paper print mode process is resumed after the non-print mode process ends. Accordingly, in this case, it is judged as a "non-print mode followed by the thick paper print mode". Similarly, in the case where a job of the thick paper print mode is received immediately after a non-print mode process starts to be executed, it is judged as the "non-print mode followed by the thick paper print mode".

If it is judged as the "non-print mode followed by the thick paper print mode" in step S52 (YES in step S52), it is judged whether or not the process time of the non-print mode process is larger than the preheat time required for the execution of the thick paper print mode (step S53).

The process time of the non-print mode process is read from the non-print mode process time storage unit 456 (FIG. 2). The preheat time $\gamma$ is obtained preliminarily by an experiment or the like, and is stored in the ROM 454 or the like. Accordingly, the preheat time $\gamma$ is read from the ROM 454 or the like.

If it is judged that the process time $\alpha$ of the color shift correction process is larger than the preheat time $\gamma$ ($\alpha>\gamma$) (YES in step S53), it is determined as "heater power OFF available" (step S54); and if it is judged that the process time $\alpha$ of the color shift correction process is equal to or smaller than the preheat time $\gamma$ (NO in step S53), it is determined as "heater power OFF not available" (step S55);

Also, it is judged that the thick paper print mode process is not to be executed after the present non-print mode process (NO in step S52), there is no need to take the preheat time into account, and thus it is determined as "heater power OFF available" (step S54).

If it is judged that the process time of the non-print mode process to be executed has not been predetermined (NO in step S51), it is determined as "heater power OFF not available" (step S55) since it is uncertain when the non-print mode process ends, and priority is given to the user's convenience.

With step S54 or S55, the subroutine for the heater power OFF availability judging process ends, and the control returns to the flowchart of FIG. 3.

Figure 18:
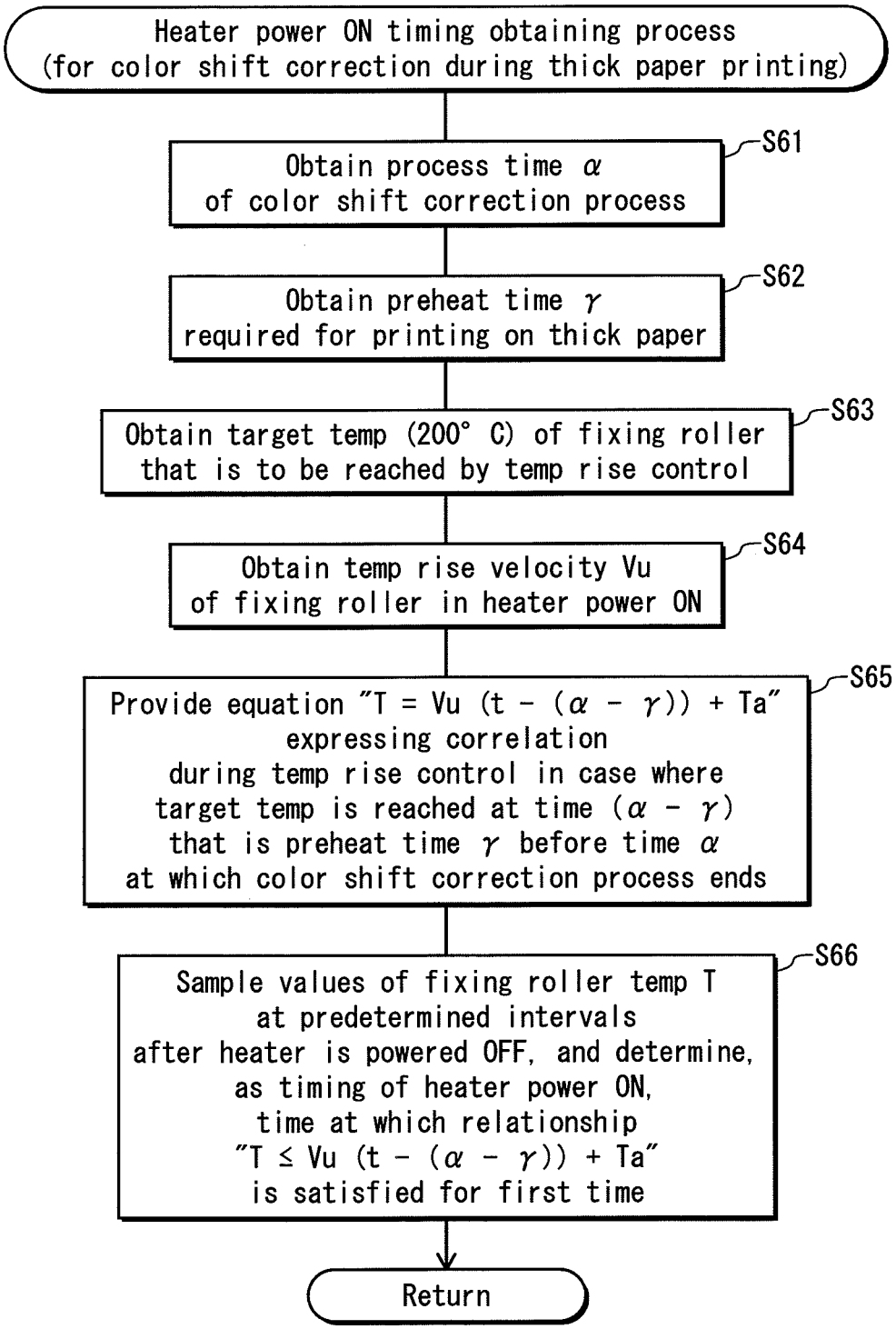
FIG. 18 is a flowchart illustrating a subroutine for the heater power ON timing obtaining process in the case of FIGS. 16A and 16B.

FIG. 18 is a flowchart illustrating a subroutine for the heater power ON timing obtaining process (step S5 in FIG. 3) in the present modification.

Note that, in the present example, the same case as that in FIG. 16A, where the thick paper print mode process is stopped and the color shift correction process is executed, is taken as an example of the executed non-print mode process. It should be noted here however that the present invention is not limited to this case.

First, a process time $\alpha$ of the non-print mode process to be executed is obtained (step S61), and then a preheat time $\gamma$ required for printing on the thick paper is obtained (step S62).

Subsequently, the target temperature Ta in the temperature rise control is set to 200° C. (step S63), and then the temperature rise velocity Vu of the fixing roller 41 during the heater power ON is obtained (step S64).

Next, an equation "T=Vu (t−(α−γ))+200" is provided, wherein the equation expresses the correlation during the temperature rise control in the case where the fixing unit temperature T reaches the target temperature Ta at time (α−γ) that is the preheat time γ before the time at which the non-print mode process ends (step S65).

Subsequently, the values of the fixing unit temperature T are sampled at predetermined intervals after the heater is powered OFF, and the time at which the relationship "T≤Vu (t−(α−γ))+200" is satisfied for the first time is determined as the timing to switch ON the heater power (step S66).

After this, the control returns to the flowchart of FIG. 3, the heater power is switched ON at the obtained timing, and the temperature rise control is executed.

Note that in the present modification, the preheat time γ is not limited to a unified time, but may be a plurality of times from which a time is selected in correspondence with the number of sheets of thick paper expected to be printed continuously.

In the latter case, a table of preheat times corresponding to values of the number of sheets of thick paper to be printed continuously is stored in the ROM 454 or the EEPROM 455, and the preheat time γ is obtained by referring to the table. The number of sheets of thick paper expected to be printed continuously can be obtained easily from the print control information attached to the header of the received print job.

In the table, the preheat time γ may be set to "0" in correspondence with a small number of sheets, such as one or two, to be printed continuously in one job for which the preheating is not necessary. With this arrangement, it is always judged as YES, heater power OFF available, in step S53 of FIG. 17. Also, by setting "γ" to "0" in each equation provided in steps S65 and S66 of FIG. 18, it is possible to determine the timing of heater power ON in the same manner as in the print process for the regular paper.

(6) In the above embodiment, the judgment on whether or not the heater power OFF is available is made based on the result of judgment on whether or not the process time of the non-print mode process to be executed has been predetermined, as in step S11 of FIG. 4.

However, there is a case where the process time of the non-print mode process to be executed has not been predetermined, but it belongs to an allowable range of errors (variations), and thus it may be judged that the heater power OFF is available.

In the following, and example case where the toner supply process is executed in the non-print mode is explained.

There are various known technologies that can be applied to a toner level sensor for detecting the remaining amount of toner in the developing unit provided in each image creating unit. For example, the toner level sensor may include a plurality of light-transmissive photoelectric sensors arranged in the vertical direction. Alternatively, the toner level sensor may include; a surface detection plate that is swingable and arranged in a state of being in contact with the surface of the toner; and a magnetic sensor that detects the movement of the detection plate when the surface falls. Meanwhile, there is a case where it is difficult to accurately predict the toner supply time due to the variation in the degree of precision of the sensor itself, the error in the attachment of the sensor, or the variation in the capability to supply toner from a toner bottle, and thus a predetermined amount of variation occurs.

Here, it is presumed that a denotes a time period that is predicted to be required for executing a typical toner supply process, the prediction being made based on a detection signal from the toner level sensor, and that the variation of the predicted time period is ±δ (δ>0). The values of α and ±δ are preliminarily obtained in the experiments in the design stage or after the assembly or the like, and are stored in the ROM 454 or the like.

If the predicted toner supply process time α is equal to or smaller than the variation amount δ (α≤δ), in the extreme case, a toner supply may be completed immediately after it is started, as shown in FIG. 19A. If the heater power is switched OFF in this case, there is a high possibility that the user experiences inconvenience.

However, if the predicted toner supply process time α is greater than the variation amount δ (α>δ), a toner supply is not completed until a predicted shortest toner supply process end time (α−δ), as shown in FIG. 19B. Accordingly, the user does not experience inconvenience if, after the heater power is switched OFF, the fixing unit temperature T is restored to the target temperature Ta until the predicted shortest toner supply process end time is reached.

Figure 20:
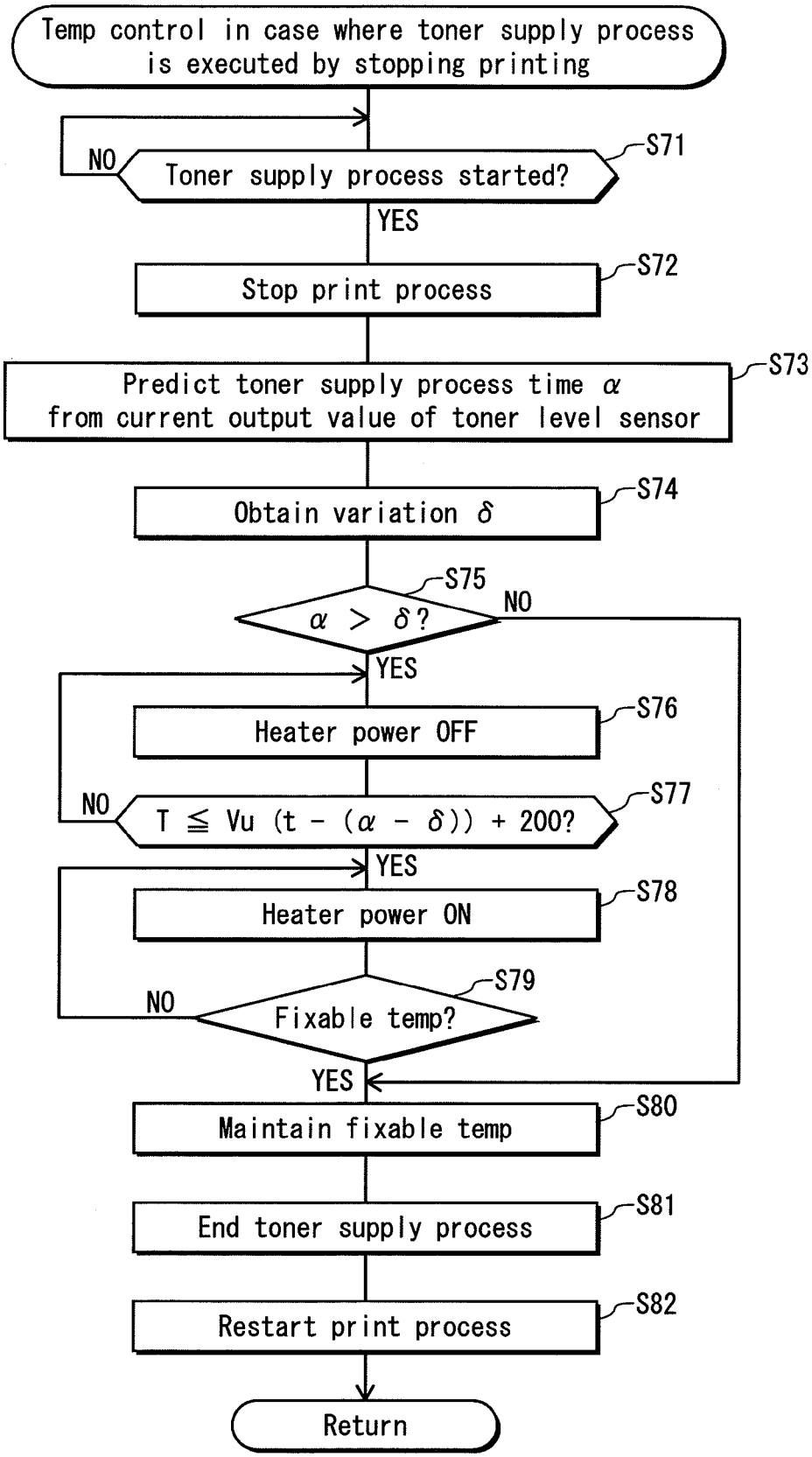
FIG. 20 is a flowchart of the temperature control of the fixing unit in the case of FIGS. 19A and 19B.

FIG. 20 is a flowchart of the temperature control performed by the controller 45 in the present embodiment.

In this example, a case where a print job is stopped to execute the toner supply process is explained.

First, in step S71, it is judged whether or not the toner supply process is started. If it is judged that the toner supply process is started (YES in step S71), the print process is stopped (step S72), and the toner supply process time α, which is a time required to fill the developing unit with toner, is predicted from the current output value of the toner level sensor (step S73). For this purpose, a table indicating a correspondence between output values of the toner level sensor and standard toner supply process times α, relational expressions between them and the like are stored in the ROM 454. A predicted value of the toner supply process time α is obtained by referring to these information.

Subsequently, the variation amount S is obtained by reading it from the ROM 454 or the like (step S74), and it is judged whether or not the predicted toner supply process time α is greater than the variation amount δ (step S75).

If α≤δ (NO in step S75), the fixable temperature is maintained (step S80) because the print start may be delayed if the heater power is switched OFF at this time (FIG. 19A).

Also, if α>δ (YES in step S75), the heater power is switched OFF (step S76).

If the fixing unit temperature T falls down and reaches "T≤Vu (t−(α−δ))+200" (YES in step S77), the heater power is switched ON (step S78), and if the fixing unit temperature T reaches the fixable temperature (YES in step S79), the fixable temperature is maintained (step S80).

Subsequently, the toner supply process ends (step S81), the print process is restarted (step S82), and the control returns to the main flowchart.

Note that when it is judged in step S75 that the predicted toner supply process time α is equal to or smaller than the variation amount δ, the fixable temperature may not be maintained as it is, but the fixing unit temperature T may be reduced to the wait temperature 170° C., and then the wait temperature 170° C. may be maintained, as shown in the dotted line in FIG. 19A.

After the toner supply process ends, the fixing unit temperature T is increased to the fixable temperature and the print process is restarted.

With this arrangement, even in the case where $\alpha \leq \delta$, electricity can be saved to some extent, and the print process can be restarted in a short time.

Figure 21:
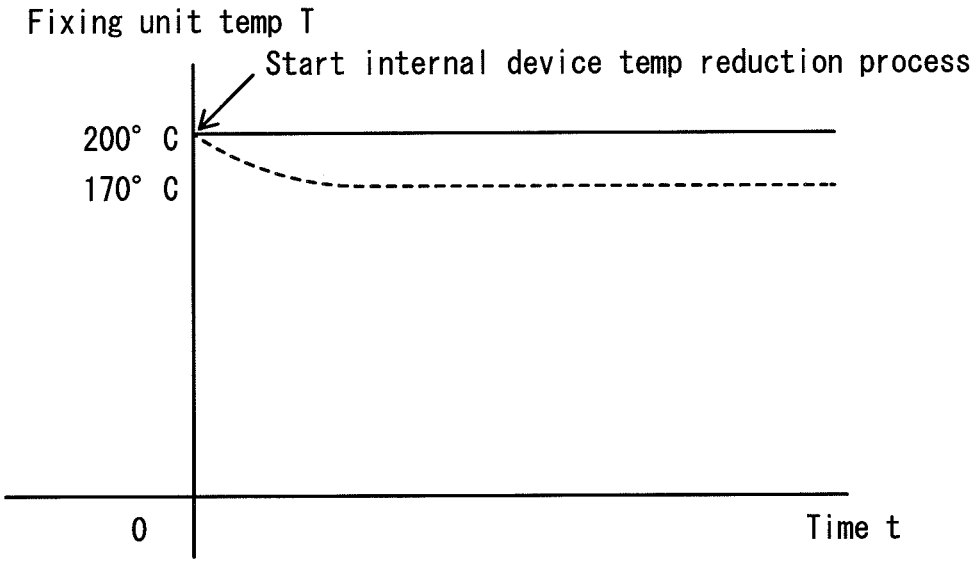
FIG. 21 is a graph showing the change in the fixing temperature in the case where a print process is stopped to execute the internal device temperature reduction process.

(7) In the above embodiment, with regard to the internal device temperature reduction process whose process time is uncertain, it is determined as "heater power OFF not available", and a control is performed to maintain the currently set temperature (NO in step S11 of FIG. 4, step S13--->NO in step S3 of FIG. 3, step S9). However, in the case of stopping the print process and executing a non-print mode process whose process time is uncertain, the fixable temperature may not be maintained as it is, but the fixing unit temperature T may be reduced to the wait temperature 170° C., and then the wait temperature 170° C. may be maintained, as shown in FIG. 21, as in the case of FIG. 19A. Then after the non-print mode process with uncertain process time ends, the fixing unit temperature T is increased to the fixable temperature and the print process is restarted. With this arrangement, even in the case where the process time is uncertain, electricity can be saved to some extent, and the print process can be restarted in a short time.

(8) If it is found, during an execution of a non-print mode process, that the non-print mode process does not need to be executed to the last, then the actual process time becomes shorter than the originally scheduled process time, and thus it is preferable that the timing of switching OFF the heater power is changed in accordance with the change in process time.

More specifically, suppose, for example, a case where a consumable used for the print process of any of the colors C, M and Y reaches its end of life during an execution of the color shift correction process. Here the "color consumable" can include, for example, the photosensitive drum in each image creating unit of the colors C, M and Y, a developing unit, and a toner bottle. The lives of these consumables are preliminarily defined. The controller 45 counts and accumulates the operation times of them (more specifically, parameters of the number of rotations of the photosensitive drum, running distance, the number of printed sheets, and so on), and stores the accumulated value in the ROM 454 or the like. When the accumulated value reaches a predetermined value, a warning may be emitted to the user, or the print process may be prohibited.

In such a case where a color consumable reaches the end of life during an execution of the color shift correction process, the color mode process cannot be executed until the color consumable is exchanged. In that case, it makes no sense to continue the color shift correction process, and thus it is reasonable to immediately stop the process and switch ON the heater power in preparation for the execution of the monochrome mode process.

Figure 22:
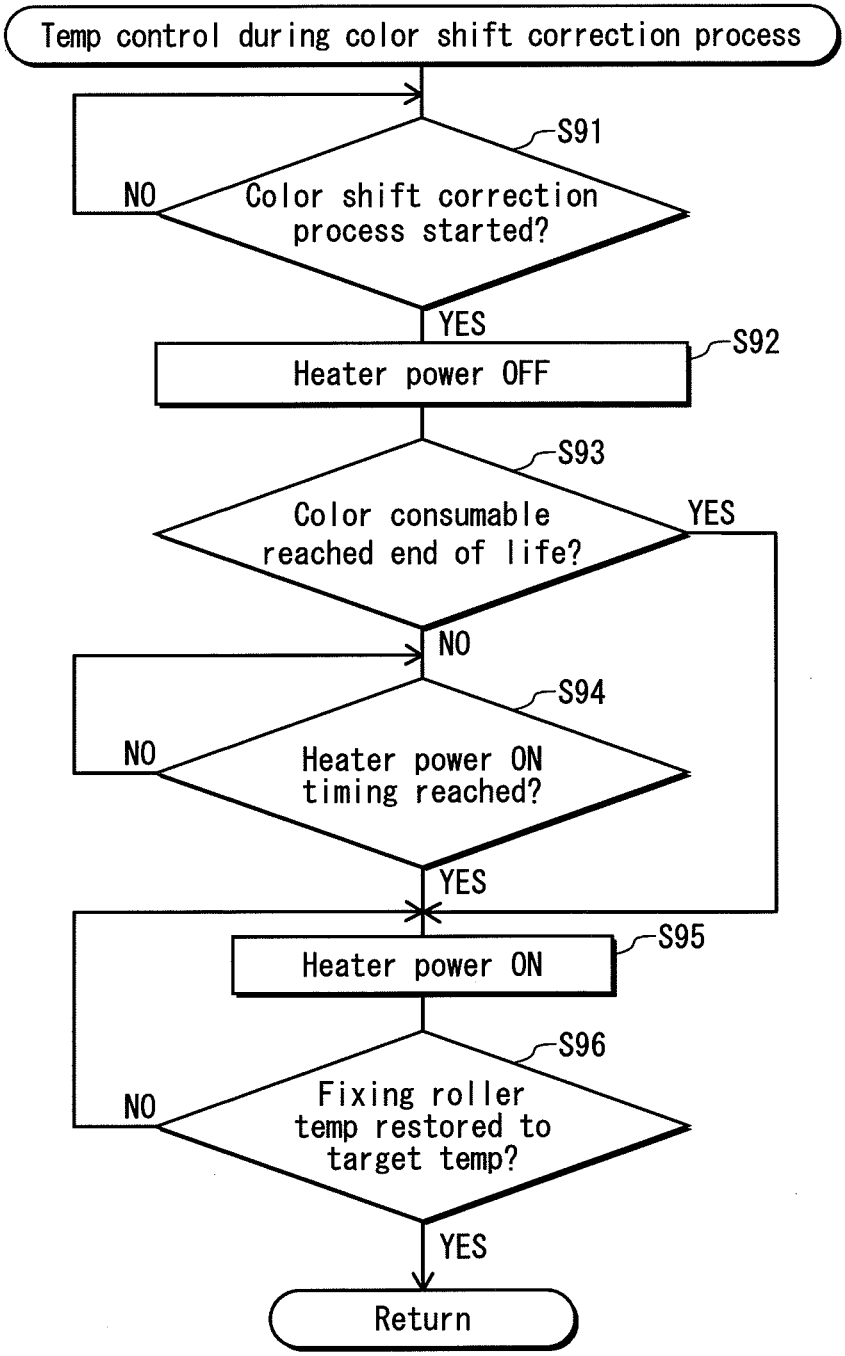
FIG. 22 is a flowchart of the temperature control in the case where a color consumable reaches the end of life during an execution of the color shift correction process.

FIG. 22 is a flowchart of the temperature control performed by the controller 45 in the above case.

First, in step S91, it is judged whether or not the color shift correction process is started, and if it is judged that the color shift correction process is started (YES in step S91), the heater power is switched OFF (step S92). Then it is judged whether or not a consumable for any of the colors C, M and Y has reached the end of life (step S93). If it is judged that no consumable has reached the end of life (NO in step S93), it is judged whether or not the heater power ON timing obtained based on the original non-print mode process time has been reached, as in the above embodiment (step S94).

If it is judged that the heater power ON timing has been reached (YES in step S94), the heater power is switched ON (step S95). The state of heater power ON is continued until the temperature of the fixing roller 41 reaches the target temperature Ta (NO in step S96, step S95). Then after the temperature of the fixing roller 41 reaches the target temperature Ta (YES in step S96), the control returns to the main flowchart.

If it is judged that a color consumable has reached the end of life (YES in step S93), the heater power is immediately switched ON (step S95), steps S95 and S96 are performed, and the control returns to the main flowchart.

Note that FIGS. 21 and 22 illustrate the case of the color shift correction process as an example of the non-print mode process. However, the present invention is not limited to this, but may be applied to the color image stabilization process, the tone supply process in a color developing unit and the like.

(9) In the above modification (1), whenever the process time of a non-print mode process to be executed is shorter than a predetermined time period, it is judged as heater power OFF not available, and a control is performed to maintain the temperature adjustment control. This is based on the judgment, on the premise that switching OFF the heater power will not produce much power saving effect, that it would contribute to the user's convenience to continue the temperature adjustment control to accumulate the heat in the fixing unit 40 in preparation for the execution of the later print process, especially a print process in which printing is to be made on a large number of sheets of paper.

The present modification places slightly more importance on the power saving effect than the modification (1).

Figure 23:
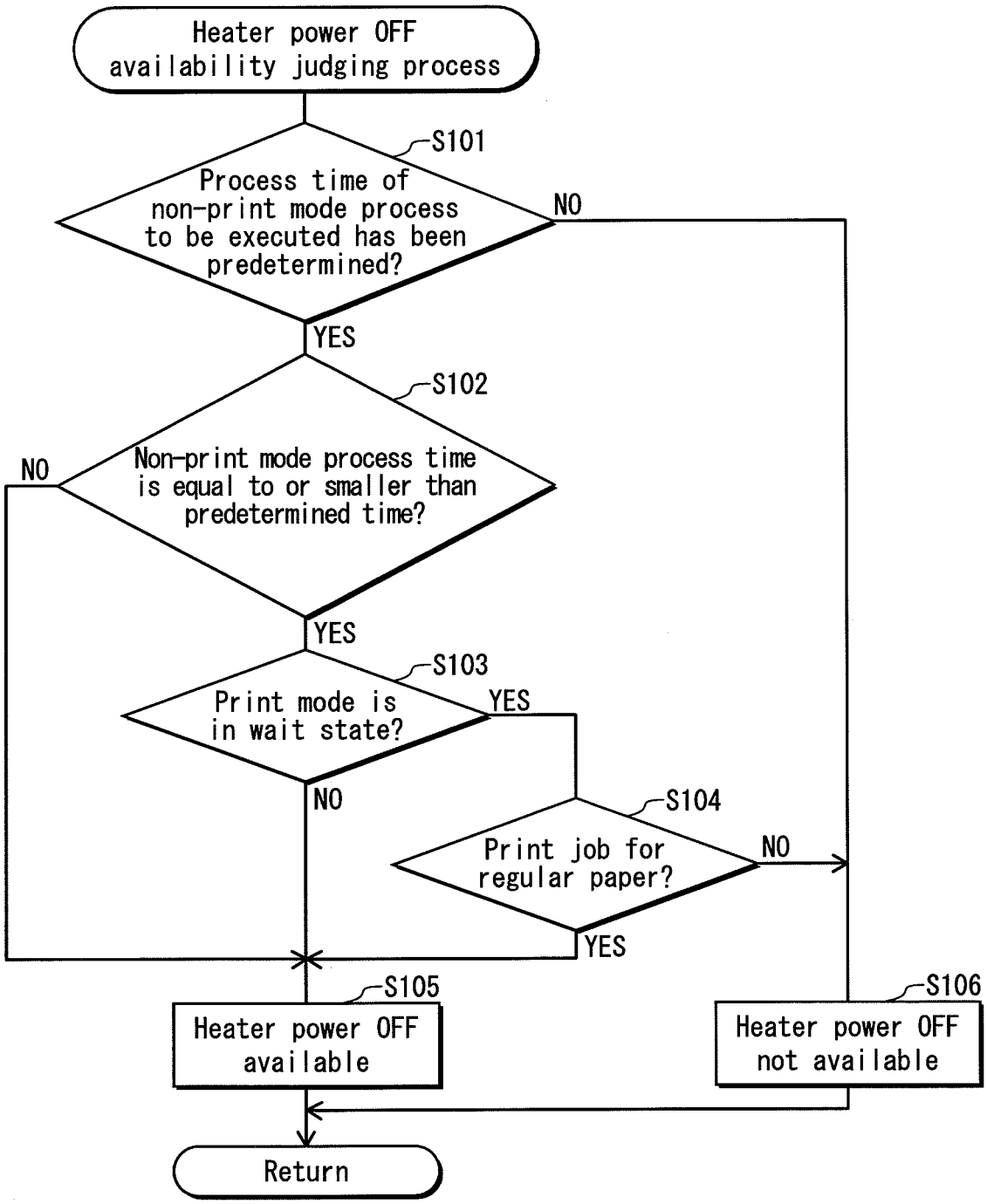
FIG. 23 is a flowchart of the heater power OFF availability judging process performed in a further modification.

FIG. 23 is a flowchart of the heater power OFF availability judging process performed by the controller 45 in the present modification.

First, it is judged whether or not the process time of the non-print mode process to be executed has been predetermined (step S101). If it is judged that the process time has been predetermined (YES in step S101), it is judged whether or not the non-print mode process time is equal to or smaller than a predetermined time (step S102). This judgment is made in a similar manner to step S11*a* (FIG. 11) in the modification (1). The predetermined time in step S102 is (td+tu).

If it is judged that the non-print mode process time is greater than the predetermined time (NO in step S102), it is determined as "heater power OFF available" (step S105).

Even if it is judged that the non-print mode process time is equal to or smaller than the predetermined time (YES in step S102), it is determined as "heater power OFF available" (step S105) if it is judged that the print mode is not in the wait state (NO in step S103) (the wait state is a state in which a print process instruction is awaited) after the non-print mode process has ended. This is because, in that state, there is hardly the necessity for accumulating the heat in the fixing unit 40. That is to say, accumulating the heat by continuing the temperature adjustment control consumes more electric power by a slight amount than raising the temperature by switching ON the heater power after switching OFF. Accordingly, in this case, more importance is placed on the power saving than accumulating heat for the convenience of the user in preparation for a print job for which it is not known when the instruction comes.

Even if it is judged that the print mode is in the wait state (YES in step S103), if it is judged that the awaited print mode process is a print job for the regular paper (YES in step S104), it is determined as "heater power OFF available" (step S105). This is because, in the case of printing onto regular paper, a fixing failure does not occur even if the heat has not been accumulated since the regular paper requires a smaller amount of heat for fixing paper than the thick paper.

Note that it is possible to recognize easily from the print condition information included in the header of the received print job, whether or not the awaited print mode process is a print job for the regular paper.

Thus according to the present modification, only if it is judged that the process time of the non-print mode process to be executed has not been predetermined (NO in step S101), or if it is judged that the awaited print mode process is a print job for the thick paper (NO in step S104), it is determined as "heater power OFF not available".

(10) In the above embodiment, the power supply to the heater is fully stopped if it is determined as "heater power OFF available". However, not limited to this, the duty ratio of ON in the ON/OFF control may be reduced (namely, the amount of power supply may be reduced) to decrease the fall velocity of the fixing unit temperature T. This produces the power saving effect to some extent.

(11) In the above embodiment, the wait temperature is set to 170° C. However, not limited to this, it is possible to provide a power saving mode in which the target temperature is set to a temperature lower than 170° C. (for example, 120° C.) by placing more importance on the power saving. In this case, switching from the wait state to the power saving mode may be performed automatically if no print job is received in the wait state for a predetermined time period. Alternatively, the power saving mode may be set in accordance with a specification by the user via the operation panel 35.

(12) As examples of the processes that can be executed in the non-print mode, the processes indicated in the table shown in FIG. 6A are provided in the above embodiment, and the toner supply process is provided in the above modification (6). However, not limited to these, any processes may be included as far as the processes do not involve the thermal fixing performed by the fixing device and the processes are not executed together with any print mode processes.

The following are examples of other non-print mode processes whose process times have been predetermined.

(a) A process (post-processing function switching process) for switching among a plurality of post-processing functions in the printer that is loaded with a post-processing device (a finisher) that provides the post-processing functions. For example, this process may be executed to switch from the punch function to the staple function.

(b) A cleaning process in the case where the photosensitive drum is cleaned to remove the remaining toner.

(c) A process for switching among a plurality of system speeds in a type of apparatus that can change the system speed (speed down) when the regular paper print process is switched to the thick paper print process, or when the monochrome mode is switched to the color mode.

(d) A switching process for switching from the monochrome mode to the color mode (a process for preliminarily stirring the toner in the color developing unit to cause the toner to be electrically charged. In the case of a type of apparatus that has a mechanism for causing the intermediate transfer belt to be distanced away from the color photosensitive drums in the monochrome mode, a process, for example, for causing the photosensitive drums to be close to the intermediate transfer belt).

(e) A process for extending and converting the image data in a print job into a format for the print process (the time required for extending the image data can be predicted from the amount of data).

Note that a special case where a process is performed when recording sheets have been extracted from the paper feed cassette may be regarded as a process of the non-print mode, and in this case, the process time is judged to be uncertain.

(13) The present invention is not limited to a type of fixing unit that uses a fixing roller as a heating rotating member. In view of the property of the present invention to secure the convenience of the user by reducing the time interval from the end of a non-print mode process to the start of an image forming operation, it can be said that the present invention produces the advantageous effect especially in an apparatus that takes a certain amount of time for warming-up.

(14) In the above description, an example case where the developing device and image forming apparatus of the present invention are applied to a tandem color printer is described. However, the present invention is not limited to this in applicable range, but may be applied to almost all image forming apparatuses provided with a developing device, such as a color printer or a copier of the four-cycle type, a copier, a facsimile apparatus, and a Multiple Function Peripheral (MFP).

Also, the present invention may be any combination of the above embodiment and modifications.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

a first executing unit that executes an image formation mode which includes a printing process of forming an image by transferring a toner image from an image holder onto a recording sheet, and then, in a fixing device, causing a fixing member heated to a fixable temperature by a heater to thermally fix the toner image on the recording sheet;

a second executing unit that executes a non-image-formation mode process that is different from a wait state and that does not include a thermal fixing performed by the fixing device;

an instructing unit that selectively instructs the first executing unit to execute the image formation mode or the second executing unit to execute the non-image-formation mode process;

a controller that controls a power supply to the heater of the fixing device in accordance with an execution state of the image formation mode and the non-image-formation mode process, wherein the controller performs: (i) a first control of decreasing a temperature of the fixing member by stopping or reducing the power supply to the heater when the non-image-formation mode process starts to be executed, and (ii) a second control of stopping the first control at a predetermined timing in a middle of the execution of the non-image-formation mode process and then increasing the temperature of the fixing member so that the temperature reaches a predetermined target temperature at an end of the execution of the non-image-formation mode process;

an obtaining unit that obtains a process time of the non-image-formation mode process to be executed; and a prohibiting unit that prohibits the controller from executing the first control and the second control if the process time is equal to or smaller than a predetermined time.

2. The image forming apparatus of claim 1, wherein if a thick paper job, which is a job for forming an image on thick paper, is scheduled to be executed in the image formation mode immediately after execution of the non-image-formation mode process, the predetermined time is a preheat time having been set for execution of the thick paper job.

3. The image forming apparatus of claim 1, wherein the predetermined time is a sum of a first time and a second time, the first time being a time required for the first control to decrease the temperature of the fixing member to a normal temperature, and the second time being a time required for the second control to increase the temperature of the fixing member from the normal temperature to the target temperature.

4. The image forming apparatus of claim 1, wherein the predetermined time is a time obtained by $$(T1*V2+T2*V1-Tr*(V1+V2))/(V1*V2),$$

V1 denoting a velocity at which the temperature of the fixing member decreases during the first control, V2 denoting a velocity at which the temperature of the fixing member increases during the second control, T1 denoting the temperature of the fixing member at a start of the first control, T2 denoting the target temperature in the second control, and Tr denoting a normal temperature.

5. The image forming apparatus of claim 1, wherein the process time is a standard process time predicted for the execution of the non-image-formation mode process, and the predetermined time is a margin of error for the standard process time.

6. The image forming apparatus of claim 5, wherein when the temperature of the fixing member is the fixable temperature at a start of an execution of the non-image-formation mode process, and the first control and the second control are prohibited because the standard process time is equal to or smaller than the margin of error, the controller executes a third control of decreasing the temperature of the fixing member to a wait temperature that is lower than the fixable temperature when the non-image-formation mode process starts to be executed, and maintaining the temperature of the fixing member to be at the wait temperature at least until an end of the non-image-formation mode process.

7. The image forming apparatus of claim 1, wherein even if the process time is equal to or smaller than the predetermined time, if the printing process of the image formation mode is not to be executed immediately after execution of the non-image-formation mode process, the controller executes the first control and the second control.

8. The image forming apparatus of claim 1, wherein even if the process time is equal to or smaller than the predetermined time, if a job for forming an image on regular paper is scheduled to be executed in the image formation mode immediately after execution of the non-image-formation mode process, the controller executes the first control and the second control.

9. The image forming apparatus of claim 1, wherein if the process time of the non-image-formation mode process is extended, the prohibiting unit judges whether or not the process time after the extension is equal to or smaller than the predetermined time, and based on a result of the judgment, determines whether or not to prohibit the controller from executing the first control and the second control.

10. The image forming apparatus of claim 9, wherein the process time of the non-image-formation mode process is extended if an execution of a color shift correction process results in a failure and both an image density adjustment process and the color shift correction process are to be executed as the non-image-formation mode process.

11. An image forming apparatus comprising:

a first executing unit that executes an image formation mode which includes a printing process of forming an image by transferring a toner image from an image holder onto a recording sheet, and then, in a fixing device, causing a fixing member heated to a fixable temperature by a heater to thermally fix the toner image on the recording sheet;

a second executing unit that executes a non-image-formation mode process that is different from a wait state and that does not include a thermal fixing performed by the fixing device;

an instructing unit that selectively instructs the first executing unit to execute the image formation mode or the second executing unit to execute the non-image-formation mode process;

a controller that controls a power supply to the heater of the fixing device in accordance with an execution state of the image formation mode and the non-image-formation mode process, wherein the controller performs: (i) a first control of decreasing a temperature of the fixing member by stopping or reducing the power supply to the heater when the non-image-formation mode process starts to be executed, and (ii) a second control of stopping the first control at a predetermined timing in a middle of the execution of the non-image-formation mode process and then increasing the temperature of the fixing member so that the temperature reaches a predetermined target temperature at an end of the execution of the non-image-formation mode process; and a prohibiting unit that prohibits the controller from executing the first control and the second control if a process time of the non-image-formation mode process to be executed is uncertain.

12. The image forming apparatus of claim 11, wherein when the temperature of the fixing member is the fixable temperature at a start of an execution of the non-image-formation mode process whose process time is uncertain, the controller executes a third control of decreasing the temperature of the fixing member to a wait temperature that is lower than the fixable temperature when the non-image-formation mode process starts to be executed, and maintaining the temperature of the fixing member to be at the wait temperature at least until an end of the non-image-formation mode process.

13. An image forming apparatus comprising:

a first executing unit that executes an image formation mode which includes a printing process of forming an image by transferring a toner image from an image holder onto a recording sheet, and then, in a fixing device, causing a fixing member heated to a fixable temperature by a heater to thermally fix the toner image on the recording sheet;

a second executing unit that executes a non-image-formation mode process that is different from a wait state and that does not include a thermal fixing performed by the fixing device;

an instructing unit that selectively instructs the first executing unit to execute the image formation mode or the second executing unit to execute the non-image-formation mode process; and a controller that controls a power supply to the heater of the fixing device in accordance with an execution state of the image formation mode and the non-image-formation mode process, wherein the controller performs: (i) a first control of decreasing a temperature of the fixing member by stopping or reducing the power supply to the heater when the non-image-formation mode process starts to be executed, and (ii) a second control of stopping the first control at a predetermined timing in a middle of the execution of the non-image-formation mode process and then increasing the temperature of the fixing member so that the temperature reaches a predetermined target temperature at an end of the execution of the non-image-formation mode process, wherein:

if the printing process of the image formation mode is scheduled to be executed immediately after execution of the non-image-formation mode process, the target temperature to which the fixing member is to be increased in the second control is the fixable temperature, and if the printing process of the image formation mode is not scheduled to be executed immediately after execution of the non-image-formation mode process, the target temperature to which the fixing member is to be increased in the second control is a wait temperature that is lower than the fixable temperature.

14. The image forming apparatus of claim 13, wherein a case in which the printing process of the image formation mode is scheduled to be executed immediately after execution of the non-image-formation mode process is a case in which the non-image-formation mode process is started by stopping execution of the printing process of the image formation mode and execution of the printing process of the image formation mode is restarted immediately after execution of the non-image-formation mode process is ended.

15. The image forming apparatus of claim 13, wherein a case in which the printing process of the image formation mode is scheduled to be executed immediately after execution of the non-image-formation mode process is a case in which a job for the image formation mode is received after the non-image-formation mode process starts to be executed and an instruction to execute the job is awaited.

16. An image forming apparatus comprising:

a first executing unit that executes an image formation mode which includes a printing process of forming an image by transferring a toner image from an image holder onto a recording sheet, and then, in a fixing device, causing a fixing member heated to a fixable temperature by a heater to thermally fix the toner image on the recording sheet;

a second executing unit that executes a non-image-formation mode process that is different from a wait state and that does not include a thermal fixing performed by the fixing device;

an instructing unit that selectively instructs the first executing unit to execute the image formation mode or the second executing unit to execute the non-image-formation mode process;

a controller that controls a power supply to the heater of the fixing device in accordance with an execution state of the image formation mode and the non-image-formation mode process, wherein the controller performs: (i) a first control of decreasing a temperature of the fixing member by stopping or reducing the power supply to the heater when the non-image-formation mode process starts to be executed, and (ii) a second control of stopping the first control at a predetermined timing in a middle of the execution of the non-image-formation mode process and then increasing the temperature of the fixing member so that the temperature reaches a predetermined target temperature at an end of the execution of the non-image-formation mode process;

wherein the controller includes a determining unit that determines a timing for switching from the first control to the second control based on a process time of the non-image-formation mode process to be executed, a current temperature of the fixing member, the predetermined target temperature in the second control, and a velocity at which the temperature of the fixing member increases during the second control.

17. The image forming apparatus of claim 16, wherein if a thick paper job, which is a job for forming an image on thick paper, is scheduled to be executed in the image formation mode immediately after the non-image-formation mode process, the determining unit determines the switching timing on a presumption that the non-image-formation mode process ends within a time period that is shorter than the process time of the non-image-formation mode process by a preheat time that has been set for an execution of the thick paper job.

18. The image forming apparatus of claim 16, wherein if a predetermined range of errors is expected for a standard process time predicted for the execution of the non-image-formation mode process, the determining unit determines the switching timing on a presumption that the process time of the non-image-formation mode process is a shortest time among times obtained by subtracting the predetermined range of errors from the standard process time.

19. The image forming apparatus of claim 16, wherein if the process time of the non-image-formation mode process is extended, the determining unit re-determines the timing for switching from the first control to the second control so that the temperature reaches the predetermined target temperature after an elapse of the process time of the non-image-formation mode process after the extension.

20. The image forming apparatus of claim 16, wherein upon detecting that an actual process time of the non-image-formation mode process is shorter than the process time of the non-image-formation mode process during an execution of the first control, the determining unit immediately stops the execution of the first control and controls the temperature of the fixing member so as to be increased to the target temperature.

21. A temperature control method for a fixing device of an image forming apparatus that selectively executes an image formation mode and a non-image-formation mode process, the image formation mode being a mode which includes a printing process of forming an image by transferring a toner image from an image holder onto a recording sheet, and then, in the fixing device, causing a fixing member heated to a fixable temperature by a heater to thermally fix the toner image on the recording sheet, and the non-image-formation mode process being a process which is different from a wait state and which does not include a thermal fixing performed by the fixing device, the temperature control method comprising:

performing a first control of decreasing a temperature of the fixing member by stopping or reducing the power supply to the heater when the non-image-formation mode process starts to be executed;

performing a second control of increasing, at a predetermined timing in a middle of the execution of the non-image-formation mode process, the temperature of the fixing member so that the temperature reaches a predetermined target temperature at an end of the execution of the non-image-formation mode process;

obtaining a process time of the non-image-formation mode process to be executed; and prohibiting execution of said first control and said second control if the obtained process time is equal to or smaller than a predetermined time.

22. A temperature control method for a fixing device of an image forming apparatus that selectively executes an image formation mode and a non-image-formation mode process, the image formation mode being a mode which includes a printing process of forming an image by transferring a toner image from an image holder onto a recording sheet, and then, in the fixing device, causing a fixing member heated to a fixable temperature by a heater to thermally fix the toner image on the recording sheet, and the non-image-formation mode process being a process which is different from a wait state and which does not include a thermal fixing performed by the fixing device, the temperature control method comprising:

performing a first control of decreasing a temperature of the fixing member by stopping or reducing the power supply to the heater when the non-image-formation mode process starts to be executed;

performing a second control of increasing, at a predetermined timing in a middle of the execution of the non-image-formation mode process, the temperature of the fixing member so that the temperature reaches a predetermined target temperature at an end of the execution of the non-image-formation mode process; and prohibiting execution of said first control and said second control if a process time of the non-image-formation mode process to be executed is uncertain.

23. The image forming apparatus of claim 1, further comprising:

an image transferring device that transfers the toner image from the image holder onto the recording sheet;

wherein the first executing unit executes the image formation mode by causing the image transferring device to transfer the toner image from the image holder onto the recording sheet.

24. A temperature control method for a fixing device of an image forming apparatus that selectively executes an image formation mode and a non-image-formation mode process, the image formation mode being a mode which includes a printing process of forming an image by transferring a toner image from an image holder onto a recording sheet, and then, in the fixing device, causing a fixing member heated to a fixable temperature by a heater to thermally fix the toner image on the recording sheet, and the non-image-formation mode process being a process which is different from a wait state and which does not include a thermal fixing performed by the fixing device, the temperature control method comprising:

performing a first control of decreasing a temperature of the fixing member by stopping or reducing the power supply to the heater when the non-image-formation mode process starts to be executed; and performing a second control of increasing, at a predetermined timing in a middle of the execution of the non-image-formation mode process, the temperature of the fixing member so that the temperature reaches a predetermined target temperature at an end of the execution of the non-image-formation mode process;

wherein:

if the printing process of the image formation mode is scheduled to be executed immediately after execution of the non-image-formation mode process, the target temperature to which the fixing member is to be increased in the second control is the fixable temperature, and if the printing process of the image formation mode is not scheduled to be executed immediately after execution of the non-image-formation mode process, the target temperature to which the fixing member is to be increased in the second control is a wait temperature that is lower than the fixable temperature.

25. A temperature control method for a fixing device of an image forming apparatus that selectively executes an image formation mode and a non-image-formation mode process, the image formation mode being a mode which includes a printing process of forming an image by transferring a toner image from an image holder onto a recording sheet, and then, in the fixing device, causing a fixing member heated to a fixable temperature by a heater to thermally fix the toner image on the recording sheet, and the non-image-formation mode process being a process which is different from a wait state and which does not include a thermal fixing performed by the fixing device, the temperature control method comprising:

performing a first control of decreasing a temperature of the fixing member by stopping or reducing the power supply to the heater when the non-image-formation mode process starts to be executed;

performing a second control of increasing, at a predetermined timing in a middle of the execution of the non-image-formation mode process, the temperature of the fixing member so that the temperature reaches a predetermined target temperature at an end of the execution of the non-image-formation mode process; and determining a timing for switching from the first control to the second control based on a process time of the non-image-formation mode process to be executed, a current temperature of the fixing member, the predetermined target temperature in the second control, and a velocity at which the temperature of the fixing member increases during the second control.

* * * * *